US006202428B1

(12) United States Patent
Katayama et al.

(10) Patent No.: US 6,202,428 B1
(45) Date of Patent: Mar. 20, 2001

(54) AIR CONDITIONER

(75) Inventors: Masashi Katayama; Makoto Araki; Masaki Fujino; Jyunya Tanaka; Motonobu Furukawa; Akira Shimada; Shuji Takeda; Hiroki Tomoda; Mitsuru Shiraishi; Keiichi Nakamura; Takefumi Inagaki, all of Kawasaki (JP)

(73) Assignee: Fujitsu General Limited, Kawasaki (JP)

( * ) Notice: Subject to any disclaimer, the term of this patent is extended or adjusted under 35 U.S.C. 154(b) by 0 days.

(21) Appl. No.: 09/394,714

(22) Filed: Sep. 13, 1999

(30) Foreign Application Priority Data

| | | |
|---|---|---|
| Sep. 14, 1998 | (JP) | 10-279441 |
| Sep. 14, 1998 | (JP) | 10-279442 |
| Sep. 30, 1998 | (JP) | 10-278888 |
| Sep. 30, 1998 | (JP) | 10-278889 |
| Dec. 8, 1998 | (JP) | 10-348082 |

(51) Int. Cl.[7] ..... F25B 13/00

(52) U.S. Cl. ..... 62/160; 62/324.6; 62/505

(58) Field of Search ..... 62/160, 505, 513, 62/324.6, 324.1

(56) References Cited

U.S. PATENT DOCUMENTS

| | | | | |
|---|---|---|---|---|
| 2,978,881 | * | 4/1961 | Alsing | 62/324 |
| 2,979,917 | * | 4/1961 | Meagher | 62/196 |
| 3,006,163 | * | 10/1961 | Kooiker | 62/324 |
| 3,006,164 | * | 10/1961 | McMillan | 62/324 |
| 4,484,454 | * | 11/1984 | Sugiyama | 62/222 |
| 5,674,053 | * | 10/1997 | Paul et al. | 417/228 |
| 5,716,197 | * | 2/1998 | Paul et al. | 417/228 |
| 5,769,610 | * | 6/1998 | Paul et al. | 417/228 |

* cited by examiner

*Primary Examiner*—Corrine McDermott
*Assistant Examiner*—Marc Norman
(74) *Attorney, Agent, or Firm*—Kanesaka & Takeuchi

(57) ABSTRACT

In an air conditioner having a refrigerant circuit in which a compressor, a four-way switching valve, an outdoor-side heat exchanger, an expansion valve, and an indoor-side heat exchanger are connected in succession via pipes, the interior of an enclosed vessel of a compressor, which contains a refrigerant compressing section and an electric motor, is divided airtightly into a refrigerant discharge chamber and an electric motor chamber, two refrigerant flow path pipes are provided on the electric motor chamber side, and these refrigerant flow path pipes are appropriately switched to the refrigerant discharge side and the refrigerant suction side of the compressor via the four-way switching valve, whereby one compressor can be used as an internal high pressure type or an internal low pressure type.

18 Claims, 15 Drawing Sheets

AIR CONDITIONER

TECHNICAL FIELD

The present invention relates to an air conditioner and, more particularly, to a compressor used for reversible refrigerant circuit (reversible refrigeration cycle) capable of performing the switching between cooling operation and heating operation.

BACKGROUND ART

An air conditioner has a refrigerant circuit in which an outdoor-side heat exchanger, an expansion valve, and an indoor-side heat exchanger are connected with a compressor in a loop form by refrigerant pipes via a four-way switching valve. In the air conditioner, by switching the flow direction of a refrigerant by means of the four-way switching valve, either of cooling operation and heating operation is set.

A compressor used for this refrigerant circuit is broadly classified into an internal high pressure type and an internal low pressure type. FIG. 20 shows a refrigerant circuit using an internal high pressure type compressor 1A, and FIG. 21 shows a refrigerant circuit using an internal low pressure type compressor 1B.

The basic configurations of the compressors 1A and 1B are the same. The compressor of either type has a cylindrical enclosed vessel 2, and the enclosed vessel 2 contains a refrigerant compressing section 3 and an electric motor 4. Although not shown in detail, the refrigerant compressing section 3, being of a scroll type, has a compression chamber formed by engaging a fixed scroll having a spiral wrap on an end plate with an orbiting scroll driven by the electric motor 4.

The interior of the enclosed vessel 2 is divided into two chambers by the end plate on the side of the fixed scroll in the refrigerant compressing section 3. One of these two chambers is a refrigerant discharge chamber 5 provided on the side of a discharge port 3*a* of the refrigerant compressing section 3. The other is an electric motor chamber 6 in which the electric motor 4 is contained. Also, the electric motor chamber 6 is provided with a bearer plate 7 which pivotally supports a driving shaft 4*a* of the electric motor 4. A subsidiary electric motor chamber 6*a* is formed on the side opposite to the refrigerant discharge chamber 5 of the electric motor chamber 6 by the bearer plate 7. The bearer plate 7 is formed with an arbitrary number of refrigerant flowing holes 7*a*.

Either of the compressors 1A and 1B is connected, via a four-way switching valve 8, with a heat exchanging circuit in which an outdoor-side heat exchanger 9, an expansion valve (or a capillary tube) 10, and an indoor-side heat exchanger 11 are connected in a loop form by refrigerant pipes.

The configurations of the internal high pressure type compressor 1A and the internal low pressure type compressor 1B differ in the following respects: That is, in the internal high pressure type compressor 1A shown in FIG. 20, the refrigerant discharge chamber 5 communicates with the electric motor chamber 6 via a communicating path 12, and a suction pipe 13 for low-pressure refrigerant drawn from the four-way switching valve 8 is directly connected to a suction port 3*b* of the refrigerant compressing section 3.

Contrarily, in the internal low pressure type compressor 1B shown in FIG. 21, the refrigerant discharge chamber 5 and the electric motor chamber 6 are independent of each other. The suction port 3*b* of the refrigerant compressing section 3 is opened on the side of the electric motor chamber 6, and the suction pipe 13 drawn from the four-way switching valve 8 is connected to the electric motor chamber 6.

The following is a description of the operations of the compressors 1A and 1B. FIG. 20 shows a state at the time of cooling operation using the internal high pressure type compressor 1A. A low-pressure refrigerant from the indoor-side heat exchanger 11 is sucked into the refrigerant compressing section 3 through the suction pipe 13. After being compressed, the refrigerant is discharged into the refrigerant discharge chamber 5 as a high-temperature high-pressure refrigerant gas. This high-temperature high-pressure refrigerant gas is supplied to the outdoor-side heat exchanger 9 through a discharge pipe 14 for high-pressure refrigerant and the four-way switching valve 8. Also, some of the high-temperature high-pressure refrigerant gas flows into the electric motor chamber 6 through the communication path 12. Thereby, the compressor 1A is classified as the internal high pressure type.

For the internal high pressure type, the discharge pipe 14 for high-pressure refrigerant is connected to the side of the subsidiary electric motor chamber 6*a,* not to the refrigerant discharge chamber 5, as indicated by the chain line in FIG. 20 so that a high-pressure refrigerant is introduced from the subsidiary electric motor chamber 6*a* to the four-way switching valve 8.

At the time of heating operation, the four-way switching valve 8 is turned 90 degrees from the state shown in FIG. 20, so that the discharge pipe 14 for high-pressure refrigerant is connected to the indoor-side heat exchanger 11, and the suction pipe 13 for low-pressure refrigerant is connected to the outdoor-side heat exchanger 9.

FIG. 21 shows a state at the time of heating operation using the internal low pressure type compressor 1B. The low-pressure refrigerant from the outdoor-side heat exchanger 9 flows into the electric motor chamber 6 through the suction pipe 13, so that the interior thereof becomes low in pressure. The low-pressure refrigerant is sucked into the refrigerant compressing section 3 through the suction port 3*b*. After being compressed, the refrigerant is discharged into the refrigerant discharge chamber 5 as a high-temperature high-pressure refrigerant gas, and is supplied to the indoor-side heat exchanger 11 through the discharge pipe 14 and the four-way switching valve 8. At the time of cooling operation; the four-way switching valve 8 is turned 90 degrees from the state shown in FIG. 21, so that the discharge pipe 14 for high-pressure refrigerant is connected to the outdoor-side heat exchanger 9, and the suction pipe 13 for low-pressure refrigerant is connected to the indoor-side heat exchanger 11.

In either of the internal high pressure type and the internal low pressure type, an object of introducing the refrigerant into the electric motor chamber is to prevent overheat of the electric motor, and these two types have advantages and disadvantages as described below.

In case of the internal high pressure type, since a lubricating oil can be separated from the refrigerant gas in the electric motor chamber, the lubricating oil is positively supplied into the compressor, by which good sealing can be provided between rubbing portions of the fixed scroll and the orbiting scroll in the refrigerant compressing section. Also, by making the interior of the electric motor chamber high in pressure, a thrust force applied to the orbiting scroll can be controlled easily, and the load on the electric motor can be decreased. Accordingly, the power consumption can be lowered.

Also, in case of the internal high pressure type, since the temperature of the enclosed vessel is higher than the ambient temperature at the time of cooling operation, the heat dissipation amount is increased, so that the cooling capacity can be increased. However, the internal high pressure type is disadvantageous in terms of heating capacity because the amount of heat dissipating from the enclosed vessel is large.

On the other hand, in case of the internal low pressure type, since the temperature of the enclosed vessel is approximately equal to the ambient temperature at the time of heating operation, the amount of heat dissipating from the enclosed vessel is small, so that the heating capacity is high. In particular, comparing with the internal high pressure type in which the high-pressure refrigerant is discharged from the subsidiary electric motor chamber through the electric motor chamber, the internal low pressure type has a high rising property at the start time of heating operation.

Specifically, the refrigerant, which has been accumulated in the compressing section at the time of stoppage, is compressed simultaneously with the start, and the high-temperature high-pressure refrigerant gas is directly supplied to the indoor-side heat exchanger, not being caused to pass through the electric motor chamber, unlike the internal high pressure type. Therefore, a sufficient refrigerant circulating amount is secured from the start, so that the temperature is increased properly.

However, in the case of the internal low pressure type, the lubricating oil supplied to the compressor is not separated from the refrigerant gas, and is discharged to the heat exchanging circuit. Therefore, not only the heat exchange capacity is decreased, but also the rubbing portions of the scroll may be seized by the shortage in the lubricating oil in the compressor.

Also, the internal low pressure type is liable to cause decreased performance because the sucked refrigerant gas is caused to pass through the electric motor chamber and is overheated by the heat in the electric motor chamber, whereby the density of the refrigerant gas is made low.

SUMMARY OF THE INVENTION

Accordingly, a first object of the present invention is to provide an air conditioner having high operation efficiency in which one compressor can be switched appropriately to an internal high pressure type and an internal low pressure type.

Also, a second object of the present invention is to provide an air conditioner in which at the time of heating operation, a compressor is operated as an internal low pressure type at the start time, and it is operated as an internal high pressure type at the time of subsequent steady operation.

To attain the above first object, a first invention provides an air conditioner having a refrigerant circuit comprising a compressor, a four-way switching valve, an outdoor-side heat exchanger and an indoor-side heat exchanger which are selectively switched and connected to the high-pressure refrigerant discharge side and the low-pressure refrigerant suction side of the compressor via the four-way switching valve, and an expansion valve connected between the outdoor-side heat exchanger and the indoor-side heat exchanger, characterized in that the compressor has an enclosed vessel, the enclosed vessel contains a refrigerant compressing section having a suction port and a discharge port and an electric motor for driving the refrigerant compressing section, and the interior of the enclosed vessel is divided airtightly into two chambers, an electric motor chamber containing the electric motor and a refrigerant discharge chamber on the side of the discharge port of the refrigerant compressing section, by the refrigerant compressing section serving as partitioning means; the suction port of the refrigerant compressing section is connected with a low-pressure refrigerant suction pipe and the refrigerant discharge chamber is connected with a high-pressure refrigerant discharge pipe, and the electric motor chamber is connected with a first refrigerant flow path pipe and a second refrigerant flow path pipe at different positions of the electric motor chamber, of four switching ports of the four-way switching valve, a first switching port is connected with the low-pressure refrigerant suction pipe of the suction port, a second switching port is connected with the high-pressure refrigerant discharge pipe of the refrigerant discharge chamber, a third switching port is connected with the first refrigerant flow path pipe of the electric motor chamber, and a fourth switching port is connected with the indoor-side heat exchanger, and also the second refrigerant flow path pipe of the electric motor chamber is connected to the side of the outdoor-side heat exchanger; at the time of cooling operation, the four-way switching valve is switched so that the first switching port and the fourth switching port communicate with each other and at the same time the second switching port and the third switching port communicate with each other, whereby the compressor is operated as an internal high pressure type; and at the time of heating operation, the four-way switching valve is switched so that the first switching port and the third switching port communicate with each other and at the same time the second switching port and the fourth switching port communicate with each other, whereby the compressor is operated as an internal low pressure type.

Some preferred modes of the first invention will be described below. It is preferable that a subsidiary electric motor chamber capable of communicating with the electric motor chamber be formed by a bearer plate pivotally supporting one end of a driving shaft of the electric motor on the side opposite to the refrigerant discharge chamber of the electric motor chamber, and the second refrigerant flow path pipe be connected to the subsidiary electric motor chamber.

Also, the low-pressure refrigerant suction pipe, the first refrigerant flow path pipe, and the high-pressure refrigerant discharge pipe are drawn from the end face on the refrigerant discharge chamber side of the enclosed vessel, and the second refrigerant flow path pipe is drawn from the end face on the electric motor chamber side of the enclosed vessel, by which pipes are eliminated from the shell periphery (peripheral surface) of the enclosed vessel. Therefore, the installation space for the compressor can be decreased, and the enclosed vessel can be assembled accurately without distortion.

Also, on the side opposite to the refrigerant discharge chamber of the electric motor chamber, the first refrigerant flow path pipe and the second refrigerant flow path pipe are installed symmetrically with respect to an imaginary vertical plane comprising the axis of the enclosed vessel and at an angle such as to point at the axis, and an oil separating plate for separating oil from a refrigerant gas is provided along the imaginary vertical plane in the electric motor chamber. Therefore, the lubricating oil can be separated from the refrigerant gas securely.

Also, the first invention includes a mode in which the enclosed vessel is placed vertically with the axis thereof being substantially vertical. In this case, the configuration may be such that the refrigerant compressing section and the electric motor are contained in the enclosed vessel in such a manner that the former is positioned above and the latter is below, and the interior of the enclosed vessel is divided airtightly into two chambers, the refrigerant discharge chamber on the side of the discharge port of the refrigerant compressing section and the electric motor chamber containing the electric motor, by the refrigerant compressing section serving as partitioning means; the suction port of the refrigerant compressing section is connected with the low-pressure refrigerant suction pipe from the side face of the enclosed vessel, and the refrigerant discharge chamber is connected with the high-pressure refrigerant discharge pipe from the side face of the opposing side of the low-pressure refrigerant suction pipe; and the first refrigerant flow path pipe is connected to the electric motor chamber from the same side face as that of the high-pressure refrigerant discharge pipe, and the second refrigerant flow path pipe is connected from the same side face as that of the low-pressure refrigerant suction pipe.

A second invention provides an air conditioner having a refrigerant circuit comprising a compressor, a four-way switching valve, an outdoor-side heat exchanger and an indoor-side heat exchanger which are selectively switched and connected to the high-pressure refrigerant discharge side and the low-pressure refrigerant suction side of the compressor via the four-way switching valve, and an expansion valve connected between the outdoor-side heat exchanger and the indoor-side heat exchanger, characterized in that the compressor has an enclosed vessel, the enclosed vessel contains a refrigerant compressing section having a suction port and a discharge port and an electric motor for driving the refrigerant compressing section, and the interior of the enclosed vessel is divided airtightly into two chambers, an electric motor chamber containing the electric motor and a refrigerant discharge chamber on the side of the discharge port of the refrigerant compressing section, by the refrigerant compressing section serving as partitioning means, and a subsidiary electric motor chamber is formed by a bearer plate pivotally supporting a driving shaft of the electric motor on the side opposite to the refrigerant discharge chamber of the electric motor chamber, a low-pressure refrigerant suction pipe drawn from a first switching port on the low-pressure refrigerant discharge side of the four-way switching valve branches into two pipes, one branch pipe is connected to the suction port of the refrigerant compressing section as a first low-pressure refrigerant suction pipe having a first opening/closing valve, and the other branch pipe is connected to the electric motor chamber as a second low-pressure refrigerant suction pipe having a second opening/closing valve; a high-pressure refrigerant discharge pipe connected to a second switching port on the high-pressure refrigerant introduction side of the four-way switching valve branches into two pipes, one branch pipe is connected to the subsidiary electric motor chamber as a first high-pressure refrigerant discharge pipe having a third opening/closing valve, and the other branch pipe is connected to the refrigerant discharge chamber as a second high-pressure refrigerant discharge pipe having a fourth opening/closing valve; further, a first bypass pipe having the fifth opening/closing valve and reaching the subsidiary electric motor chamber branches off from the downstream side of the first opening/closing valve of the first low-pressure refrigerant suction pipe, and a second bypass pipe having a sixth opening/closing valve is provided between the electric motor chamber and the refrigerant discharge chamber; a third switching port of the four-way switching valve is connected with the outdoor-side heat exchanger, and a fourth switching port of the four-way switching valve is connected with the indoor-side heat exchanger; at the time of cooling operation, the second switching port and the third switching port are caused to communicate with each other and the first switching port and the fourth switching port are caused to communicate with each other by the four-way switching valve, and the first opening/closing valve, the third opening/closing valve, and the sixth opening/closing valve are opened, and the second opening/closing valve, the fourth opening/closing valve, and the fifth opening/closing valve are closed, whereby the compressor is operated as an internal high pressure type; and at the time of heating operation, the second switching port and the fourth switching port are caused to communicate with each other and the first switching port and the third switching port are caused to communicate with each other by the four-way switching valve, and the second opening/closing valve, the fourth opening/closing valve, and the fifth opening/closing valve are opened, and the first opening/closing valve, the third opening/closing valve, and the sixth opening/closing valve are closed, whereby the compressor is operated as an internal low pressure type. This second invention also achieves the above first object.

In the second invention, after a predetermined time has passed from the start of heating operation, while the second switching port and the fourth switching port still communicate with each other and the first switching port and the third switching port still communicate with each other, the first opening/closing valve, the third opening/closing valve, and the sixth opening/closing valve are opened, and the second opening/closing valve, the fourth opening/closing valve, and the fifth opening/closing valve are closed, whereby the compressor is operated as the internal high pressure type. Thereby, the above second object is achieved.

Also, the second invention may have a mode such that a low-pressure refrigerant suction pipe drawn from a first switching port on the low-pressure refrigerant discharge side of the four-way switching valve branches into two pipes, one branch pipe is connected to the suction port of the refrigerant compressing section as a first low-pressure refrigerant suction pipe having a first opening/closing valve, the other branch pipe is connected to the electric motor chamber as a second low-pressure refrigerant suction pipe having a second opening/closing valve, a first check valve for checking a reverse flow from the electric motor chamber side is provided at the pipe end of the second low-pressure refrigerant suction pipe, and further a first bypass pipe having a second opening/closing valve is provided between the downstream side of the first opening/closing valve of the first low-pressure refrigerant suction pipe and the electric motor chamber, a second switching port on the high-pressure refrigerant introduction side of the four-way switching valve and the subsidiary electric motor chamber are connected to each other by a high-pressure refrigerant discharge pipe, the refrigerant discharge chamber and the electric motor chamber are connected to each other via a second bypass pipe having a third opening/closing valve, and further a third bypass pipe having a fourth opening/closing valve is provided between the upstream side of the third opening/closing valve of the second bypass pipe and the subsidiary electric motor chamber; the bearer plate partitioning into the electric motor chamber and the subsidiary electric motor chamber is provided with a second check valve for checking a reverse flow from the subsidiary electric motor chamber side to the electric motor chamber side; a third switching port of the four-way switching valve is connected with the outdoor-side heat exchanger, and a fourth switching port of the four-way switching valve is connected with the indoor-side heat exchanger; at the time of cooling operation, the second switching port and the third switching port are caused to communicate with each other and the first switching port and the fourth switching port are caused to communicate with each other by the four-way switching valve, and the first opening/closing valve and the third opening/closing valve are opened, and the second opening/closing valve and the fourth opening/closing valve are closed, whereby the compressor is operated as an internal high pressure type; and at the time of heating operation, the second switching port and the fourth switching port are caused to communicate with each other and the first switching port and the third switching port are caused to communicate with each other by the four-way switching valve, and the second opening/closing valve and the fourth opening/closing valve are opened, and the first opening/closing valve and the third opening/closing valve are closed, whereby the compressor is operated as an internal low pressure type.

In this case as well, after a predetermined time has passed from the start of heating operation, while the second switching port and the fourth switching port still communicate with each other and the first switching port and the third switching port still communicate with each other, the first opening/closing valve and the third opening/closing valve are opened, and the second opening/closing valve and the fourth opening/closing valve are closed, whereby the compressor is operated as the internal high pressure type. Thereby, the above second object is achieved.

A third invention provides an air conditioner having a refrigerant circuit comprising a compressor, a four-way switching valve, an outdoor-side heat exchanger and an indoor-side heat exchanger which are selectively switched and connected to the high-pressure refrigerant discharge side and the low-pressure refrigerant suction side of the compressor via the four-way switching valve, and an expansion valve connected between the outdoor-side heat exchanger and the indoor-side heat exchanger, characterized in that the compressor has an enclosed vessel, the enclosed vessel contains a refrigerant compressing section having a suction port and a discharge port and an electric motor for driving the refrigerant compressing section, and the interior of the enclosed vessel is divided airtightly into two chambers, an electric motor chamber containing the electric motor and a refrigerant discharge chamber on the side of the discharge port of the refrigerant compressing section, by the refrigerant compressing section serving as partitioning means; the refrigerant compressing section is provided with a refrigerant inflow port reaching the suction port from the side of the electric motor chamber separately from the suction port, the suction port is connected with a low-pressure refrigerant suction pipe drawn from a first switching port on the low-pressure refrigerant discharge side of the four-way switching valve, and the refrigerant inflow port is provided with a first opening/closing valve; the electric motor chamber and a second switching port on the high-pressure refrigerant introduction side of the four-way switching valve are connected to each other by a high-pressure refrigerant discharge pipe having a second opening/closing valve, the refrigerant discharge chamber and the downstream side of the second opening/closing valve of the high-pressure refrigerant discharge pipe are connected to each other by a first bypass pipe having a third opening/closing valve, and further a second bypass pipe having a fourth opening/closing valve is provided between the upstream side of the third opening/closing valve of the first bypass pipe and the electric motor chamber; a third switching port of the four-way switching valve is connected with the outdoor-side heat exchanger, and a fourth switching port of the four-way switching valve is connected with the indoor-side heat exchanger; at the time of cooling operation, the second switching port and the third switching port are caused to communicate with each other and the first switching port and the fourth switching port are caused to communicate with each other by the four-way switching valve, and the second opening/closing valve and the fourth opening/closing valve are opened, and the first opening/closing valve and the third opening/closing valve are closed, whereby the compressor is operated as an internal high pressure type; and at the time of heating operation, the second switching port and the fourth switching port are caused to communicate with each other and the first switching port and the third switching port are caused to communicate with each other by the four-way switching valve, and the first opening/closing valve and the third opening/closing valve are opened, and the second opening/closing valve and the fourth opening/closing valve are closed, whereby the compressor is operated as an internal low pressure type. This third invention also achieves the above first object In the third invention as well, after a predetermined time has passed from the start of heating operation, while the second switching port and the fourth switching port still communicate with each other and the first switching port and the third switching port still communicate with each other, the second opening/closing valve and the fourth opening/closing valve are opened, and the first opening/closing valve and the third opening/closing valve are closed, whereby the compressor is operated as the internal high pressure type. Thereby, the above second object is achieved.

A fourth invention provides an air conditioner having a refrigerant circuit comprising a compressor, a four-way switching valve, an outdoor-side heat exchanger and an indoor-side heat exchanger which are selectively switched and connected to the high-pressure refrigerant discharge side and the low-pressure refrigerant suction side of the compressor via the four-way switching valve, and an expansion valve connected between the outdoor-side heat exchanger and the indoor-side heat exchanger, characterized in that the compressor has an enclosed vessel, the enclosed vessel contains a refrigerant compressing section having a suction port and a discharge port and an electric motor for driving the refrigerant compressing section, and the interior of the enclosed vessel is divided airtightly into two chambers, an electric motor chamber containing the electric motor and a refrigerant discharge chamber on the side of the discharge port of the refrigerant compressing section, by the refrigerant compressing section serving as partitioning means; a second four-way switching valve for switching the flow direction of a high-pressure refrigerant discharged from the refrigerant discharge chamber is provided separately from a first four-way switching valve for switching the flow direction of a refrigerant with respect to the outdoor-side heat exchanger and indoor-side heat exchanger; the suction port of the refrigerant compressing section is connected with a low-pressure refrigerant suction pipe drawn from a first switching port on the low-pressure refrigerant discharge side of the second four-way switching valve, the refrigerant discharge chamber is connected with a high-pressure refrigerant discharge pipe reaching a second switching port on the high-pressure refrigerant introduction side of the second four-way switching valve, and the electric motor chamber is connected with a first refrigerant flow path pipe and a second refrigerant flow path pipe at different positions of the electric motor chamber; the first refrigerant flow path pipe is connected to a third switching port of the second four-way switching valve, and the second refrigerant flow path pipe, a fourth switching port of the second four-way switching valve, the outdoor-side heat exchanger, and the indoor-side heat exchanger each are connected to a predetermined switching port of the first four-way switching valve; at the time of cooling operation, the first switching port and the fourth switching port of the second four-way switching valve are caused to communicate with each other and at the same time the second switching port and the third switching port of the second four-way switching valve are caused to communicate with each other, and also the second refrigerant flow path pipe and the outdoor-side heat exchanger are caused to communicate with each other and at the same time the fourth switching port of the second four-way switching valve and the indoor-side heat exchanger are caused to communicate with each other by the first four-way switching valve, whereby the compressor is operated as an internal high pressure type; and at the time of heating operation, the second switching port and the fourth switching port of the second four-way switching valve are caused to communicate with each other and at the same time the first switching port and the third switching port of the second four-way switching valve are caused to communicate with each other, and also the second refrigerant flow path pipe and the outdoor-side heat exchanger are caused to communicate with each other and at the same time the fourth switching port of the second four-way switching valve and the indoor-side heat exchanger are caused to communicate with each other by the first four-way switching valve, whereby the compressor is operated as an internal low pressure type. This fourth invention also achieves the above first object.

In the fourth invention as well, after a predetermined time has passed from the start of heating operation, the first switching port and the fourth switching port of the second four-way switching valve are caused to communicate with each other and at the same time the second switching port and the third switching port of the second four-way switching valve are caused to communicate with each other, and also the second refrigerant flow path pipe and the indoor-side heat exchanger are caused to communicate with each other and at the same time the fourth switching port of the second four-way switching valve and the outdoor-side heat exchanger are caused to communicate with each other by the first four-way switching valve, whereby the compressor is operated as the internal high pressure type. Thereby, the above second object is achieved.

As a modification of the fourth invention, there may be provided a mode such that the second refrigerant flow path pipe branches into two pipes, one first branch pipe is connected to a first switching port of the first four-way switching valve via a first opening/closing valve, and the other second branch pipe is connected to a second switching port of the first four-way switching valve via a second opening/closing valve; a connecting pipe drawn from the fourth switching port of the second four-way switching valve also branches into two pipes, one third branch pipe is connected to the second switching port of the first four-way switching valve via a third opening/closing valve, and the other fourth branch pipe is connected to the first switching port of the first four-way switching valve via a fourth opening/closing valve; a third switching port of the first four-way switching valve is connected with the outdoor-side heat exchanger, and a fourth switching port thereof is connected with the indoor-side heat exchanger; at the time of cooling operation, both of the first and second four-way switching valves are switched so that the first switching port and the fourth switching port communicate with each other and at the same time the second switching port and the third switching port communicate with each other, the second opening/closing valve and the fourth opening/closing valve are opened, and the first opening/closing valve and the third opening/closing valve are closed, whereby the compressor is operated as an internal high pressure type; and at the time of heating operation, both of the first and second four-way switching valves are switched so that the second switching port and the fourth switching port communicate with each other and at the same time the first switching port and the third switching port communicate with each other, the first opening/closing valve and the third opening/closing valve are opened, and the second opening/closing valve and the fourth opening/closing valve are closed, whereby the compressor is operated as an internal low pressure type.

In this case as well, after a predetermined time has passed from the start of heating operation, the first four-way switching valve still being in the switching state at the time of heating operation, the second four-way switching valve is switched to the cooling operation state, the second opening/closing valve and the fourth opening/closing valve are opened, and the first opening/closing valve and the third opening/closing valve are closed, whereby the compressor is preferably operated as the internal high pressure type.

DETAILED DESCRIPTION

Figure 20:
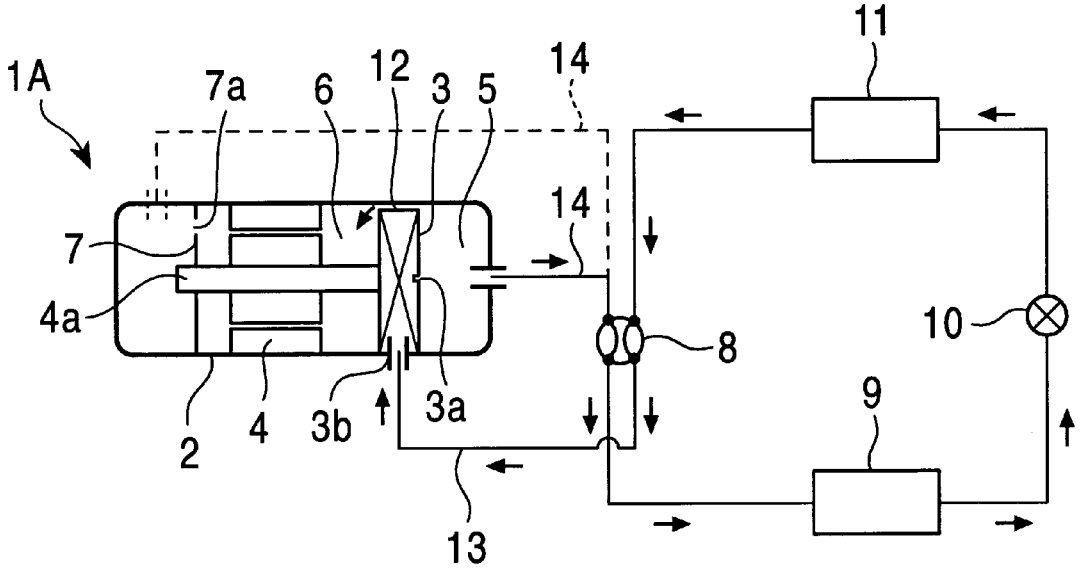
FIG. 20 PRIOR ART
FIG. 20 is a schematic view showing a refrigerant circuit of a first prior art using an internal high pressure type compressor.
Figure 21:
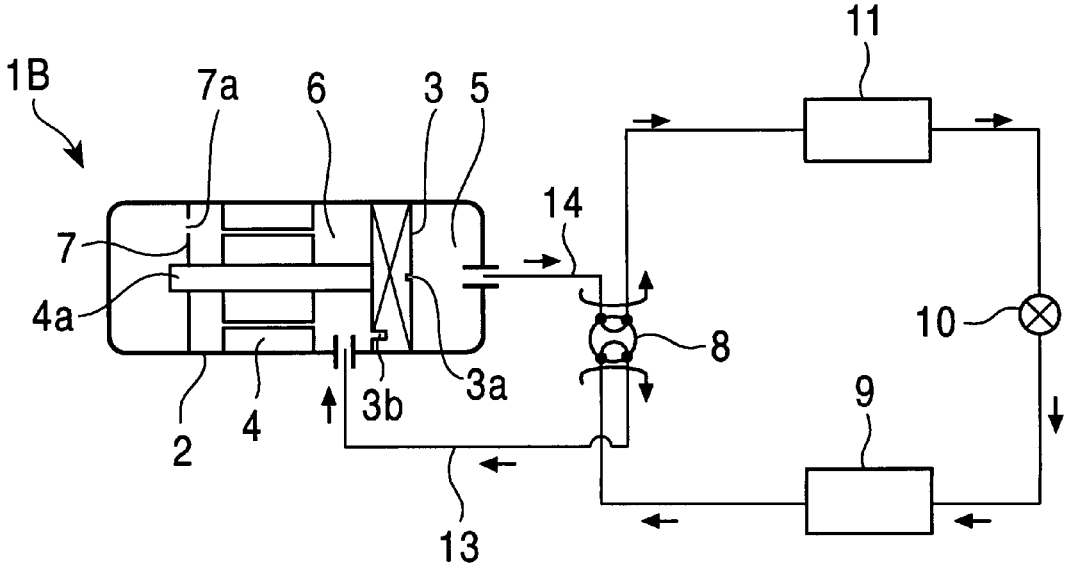
FIG. 21 PRIOR ART
FIG. 21 is a schematic view showing a refrigerant circuit of a second prior art using an internal low pressure type compressor.

First, an embodiment of a first invention will be described with reference to FIGS. 1*a* and 1*b*. In embodiments of the inventions described below, a heat exchanging circuit comprising a four-way switching valve, an outdoor-side heat exchanger, an expansion valve (or a capillary tube), and an indoor-side heat exchanger is essentially the same as that of the prior art described with reference to FIGS. 20 and 21, so that the same reference numerals are applied.

An air conditioner in accordance with the first invention has a refrigerant circuit comprising a compressor 100, a four-way switching valve 8, an outdoor-side heat exchanger 9 and an indoor-side heat exchanger 11 which are selectively switched and connected to the high-pressure refrigerant discharge side and the low-pressure refrigerant suction side of the compressor 100 via the four-way switching valve 8, and an expansion valve 10 between the outdoor-side heat exchanger 9 and the indoor-side heat exchanger 11. The expansion valve 10 may be a capillary tube.

The compressor 100 has a cylindrical enclosed vessel 101, and the enclosed vessel 101 contains a refrigerant compressing section 110 having a suction port 111 and a discharge port 112, and an electric motor 120 for driving the refrigerant compressing section 110. In this embodiment, the enclosed vessel 101 is horizontally disposed on a base frame, not shown, with the axis thereof being substantially horizontal.

Although not shown in detail, the refrigerant compressing section 110, being of a scroll type, has a compression chamber formed by engaging a fixed scroll having a spiral wrap on an end plate with an orbiting scroll driven by the electric motor 120.

The interior of the enclosed vessel 101 is airtightly divided into two chambers, a refrigerant discharge chamber 102 on the side of the discharge port 112 and an electric motor chamber 103 containing the electric motor 120, by the end plate on the side of the fixed scroll in the refrigerant compressing section 110. Also, the electric motor chamber 103 is provided with a bearer plate 122 which pivotally supports a driving shaft 121 of the electric motor 120. A subsidiary electric motor chamber 104 is formed on the side opposite to the refrigerant discharge chamber 102 of the electric motor chamber 103 by the bearer plate 122. The bearer plate 122 is formed with an arbitrary number of refrigerant flowing holes 123.

The suction port 111 of the refrigerant compressing section 110 is connected with a refrigerant suction pipe 130 for sucking a low-pressure refrigerant from a first switching port 8*a*, which is on the low-pressure refrigerant introduction side of the four-way switching valve 8. The refrigerant discharge chamber 102 is connected with a refrigerant discharge pipe 140 for supplying a high-pressure refrigerant produced in the refrigerant compressing section 110 to a second switching port 8*b*, which is on the high-pressure refrigerant discharge side of the four-way switching valve 8.

The electric motor chamber 103 is connected to one end of a first refrigerant flow path pipe 150, and the other end of the first refrigerant flow path pipe 150 is connected to a third switching port 8*c* of the four-way switching valve 8. The subsidiary electric motor chamber 104 is connected with one end of a second refrigerant flow path pipe 160, and the other end of the second refrigerant flow path pipe 160 is connected to the outdoor-side heat exchanger 9. A remaining one switching port 8*d* of the four-way switching valve 8 is connected with the indoor-side heat exchanger 11.

Figure 1A:
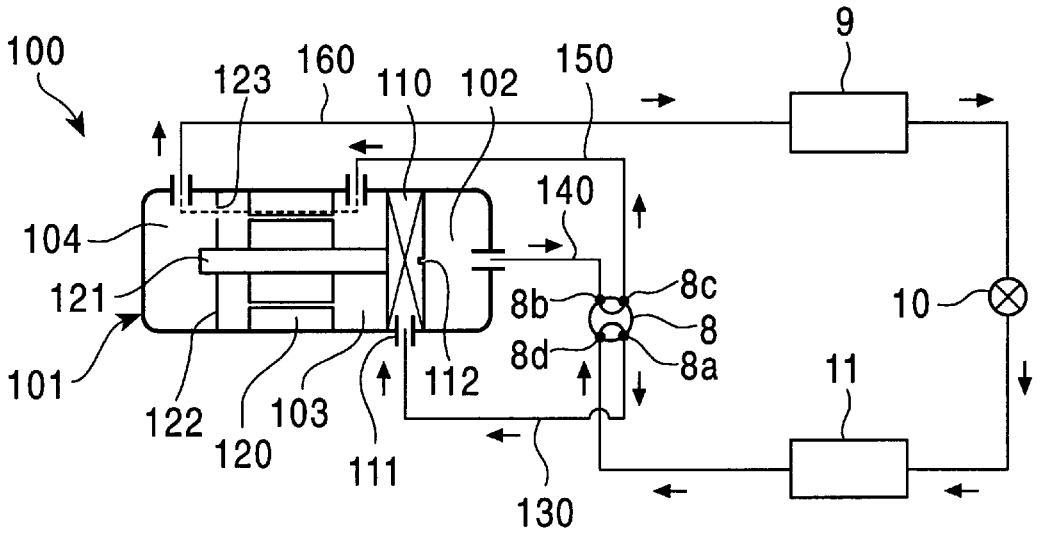
FIG. 1*a* is a schematic view showing a refrigerant circuit at the time of cooling operation using a compressor in accordance with an embodiment of a first invention as an internal high pressure type.

At the time of cooling operation, the four-way switching valve 8 is switched as shown in FIG. 1*a* so that the first switching port 8*a* and the fourth switching port 8*d* are in a communicating state, and the second switching port 8*b* and the third switching port 8*c* are in a communicating state.

Thereupon, a high-temperature high-pressure refrigerant gas produced in the refrigerant compressing section 110 flows into the electric motor chamber 103 from the refrigerant discharge chamber 102 through the refrigerant discharge pipe 140, the second switching port 8*b*, the third switching port 8*c,* and the first refrigerant flow path pipe 150, increasing the pressure in the compressor 100, and is supplied to the outdoor-side heat exchanger 9 through the second refrigerant flow path pipe 160.

The high-temperature high-pressure refrigerant gas is heat exchanged with the outdoor air in the outdoor-side heat exchanger 9, and is condensed and liquefied by discharging heat to the outside of the room. This liquid refrigerant is decompressed by the expansion valve 10, becoming in a low-temperature low-pressure gas-liquid two-phase state, and is sent to the indoor-side heat exchanger 11.

While flowing in the indoor-side heat exchanger 11, the refrigerant is evaporated by taking heat away from the indoor air, becoming a low-temperature low-pressure refrigerant gas, and is returned to the refrigerant compressing section 110 through the fourth switching port 8*d* and the first switching port 8*a* of the four-way switching valve 8, the refrigerant suction pipe 130, and the suction port 111.

Figure 1B:
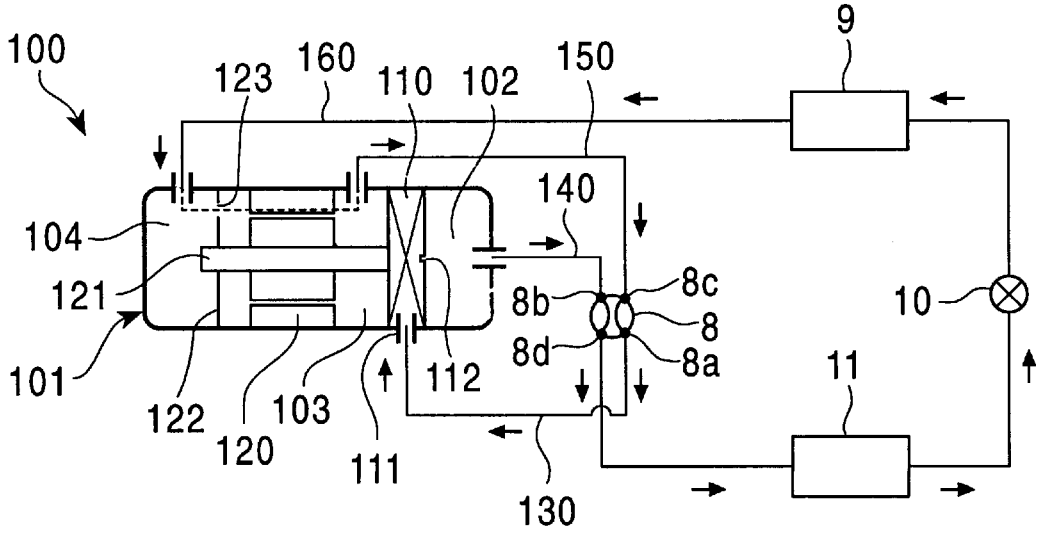
FIG. 1*b* is a schematic view showing a refrigerant circuit at the time of heating operation using a compressor in accordance with an embodiment of the first invention as an internal low pressure type.

At the time of heating operation, the four-way switching valve 8 is switched as shown in FIG. 1*b* so that the second switching port 8*b* and the fourth switching port 8*d* are in a communicating state, and the first switching port 8*a* and the third switching port 8*c* are in a communicating state.

Thereupon, the high-temperature high-pressure refrigerant gas produced in the refrigerant compressing section 110 is supplied from the refrigerant discharge chamber 102 to the side of the indoor-side heat exchanger 11 through the refrigerant discharge pipe 140, the second switching port 8*b,* and the fourth switching port 8*d,* by which heating of the room is performed. The low-pressure refrigerant gas passing through the expansion valve 10 and the outdoor-side heat exchanger 9 flows into the electric motor chamber 103 from the side of the subsidiary electric motor chamber 104 through the second refrigerant flow path pipe 160, decreasing the pressure in the compressor 100, and is returned to the refrigerant compressing section 110 through the first refrigerant flow path pipe 150, the third switching port 8*c,* the first switching port 8*a,* the refrigerant suction pipe 130, and the suction port 111.

Thus, according to the first invention, merely by switching the four-way switching valve 8, the compressor 100 can be made the internal high pressure type at the time of cooling operation, and the compressor 100 can be made the internal low pressure type at the time of heating operation.

Therefore, at the time of cooling operation, since the temperature of the enclosed vessel 101 is higher than the outdoor air temperature, the heat dissipation amount is increased, so that the cooling capacity is enhanced.

Contrarily, at the time of heating operation, the refrigerant, which has been accumulated in the compression chamber at the time of stoppage, is compressed simultaneously with the start, and the high-temperature high-pressure refrigerant gas is directly supplied to the indoor-side heat exchanger, not being caused to pass through the electric motor chamber, unlike the internal high pressure type. Therefore, a sufficient refrigerant circulating amount is secured from the start, so that the temperature can be increased properly.

Figure 2A:
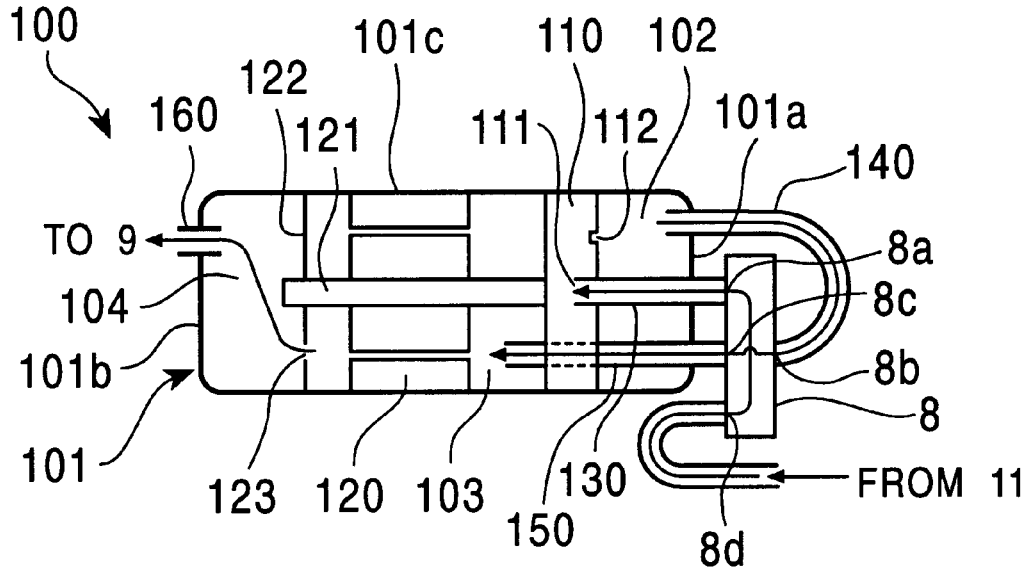
FIGS. 2*a* and 2*b* are schematic views showing a first modification of a compressor of the first invention.
Figure 2B:
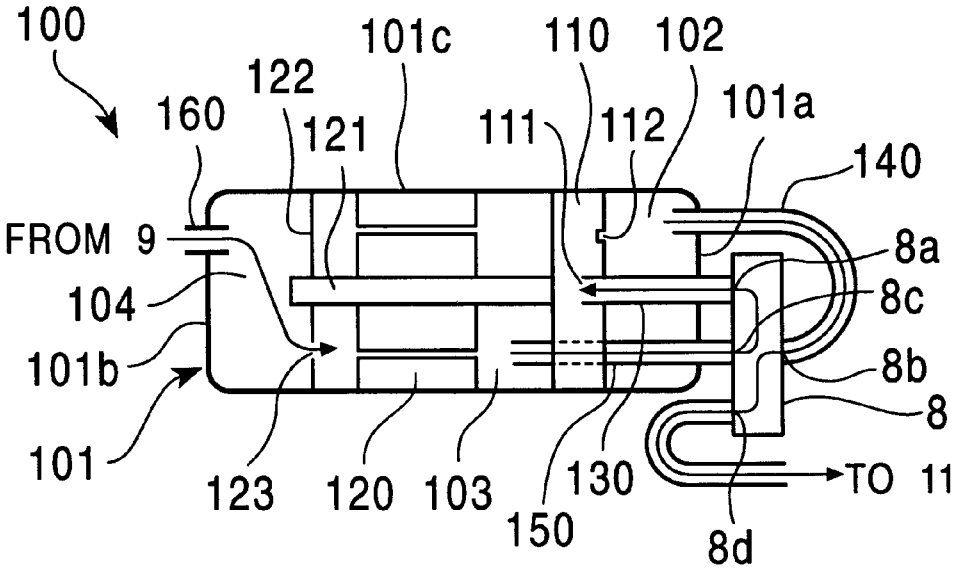

Next, modifications of the first invention will be explained. First, as shown in FIGS. 2*a* and 2*b* as a first modification, the four-way switching valve 8 may be installed integrally with the compressor 100. FIG. 2*a* shows a state in which the four-way switching valve 8 is switched to the internal high pressure type, and FIG. 2*b* shows a state in which the four-way switching valve 8 is switched to the internal low pressure type.

In this case, the low-pressure refrigerant suction pipe 130 and the first refrigerant flow path pipe 150 are not laid on the outside of the enclosed vessel 101 as in the case of the above-described embodiment, but should preferably be attached to an end face 101*a* on the side of the refrigerant discharge chamber 102 of the enclosed vessel 101.

Specifically, the low-pressure refrigerant suction pipe 130 is caused to pass through the refrigerant discharge chamber 102 and is connected to the suction port 111 of the refrigerant compressing section 110, and the first refrigerant flow path pipe 150 is caused to pass through the refrigerant discharge chamber 102 and the refrigerant compressing section 110 and is drawn into the electric motor chamber 103, by which the installation space for the low-pressure refrigerant suction pipe 130 and the first refrigerant flow path pipe 150 need not be provided on the peripheral surface (shell periphery) side of the enclosed vessel 101. Also, in a similar sense, the second refrigerant flow path pipe 160 should also preferably be connected to an end face 101*b* on the side of the subsidiary electric motor chamber 104 of the enclosed vessel 101.

Figure 3:
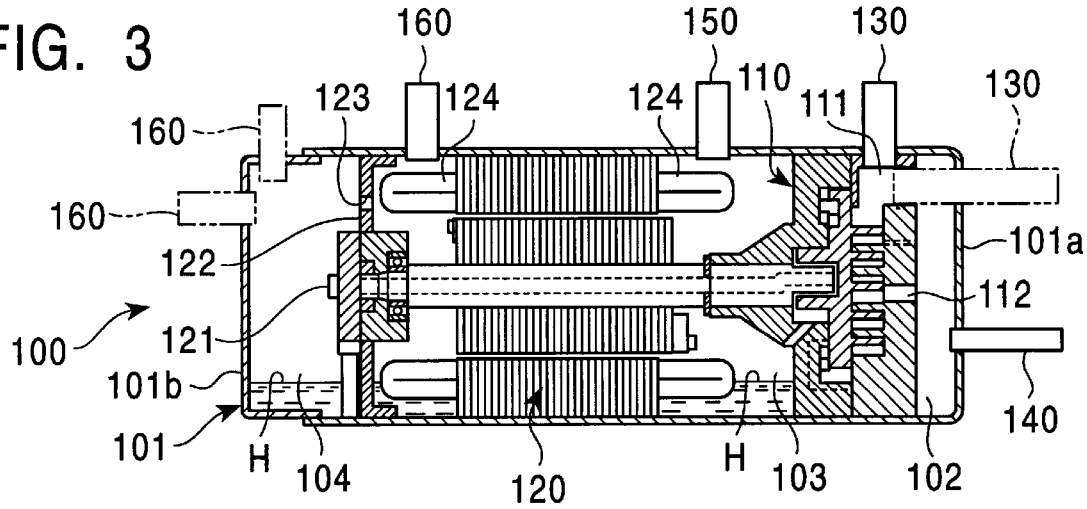
FIG. 3 is an enlarged sectional view showing a second modification of a compressor of the first invention.

Also, as shown in FIG. 3 as a second modification, the first and second refrigerant flow path pipes 150 and 160 are laid so as to be opposed to coils 124, 124 exposed at both ends of the electric motor 120 so that the refrigerant gas is blown to the coils 124, 124. Thereby, a lubricating oil is separated from the gas efficiently, so that especially at the time of heating operation, the oil surface level H in the electric motor chamber 103 and the subsidiary electric motor chamber 104 can be secured.

As indicated by a chain line in FIG. 3, the low-pressure refrigerant suction pipe 130 may be drawn into the refrigerant discharge chamber 102 from the end face 101*a* on the side of the refrigerant discharge chamber 102 of the enclosed vessel 101, and may be connected to the suction port 111 of the refrigerant compressing section 110. Also, of the first and second refrigerant flow path pipes 150 and 160, for example, the second refrigerant flow path pipe 160 may be laid at a corner portion above the subsidiary electric motor chamber 104 or on the end face 101*b* on the side of the subsidiary electric motor chamber 104.

Figure 4:
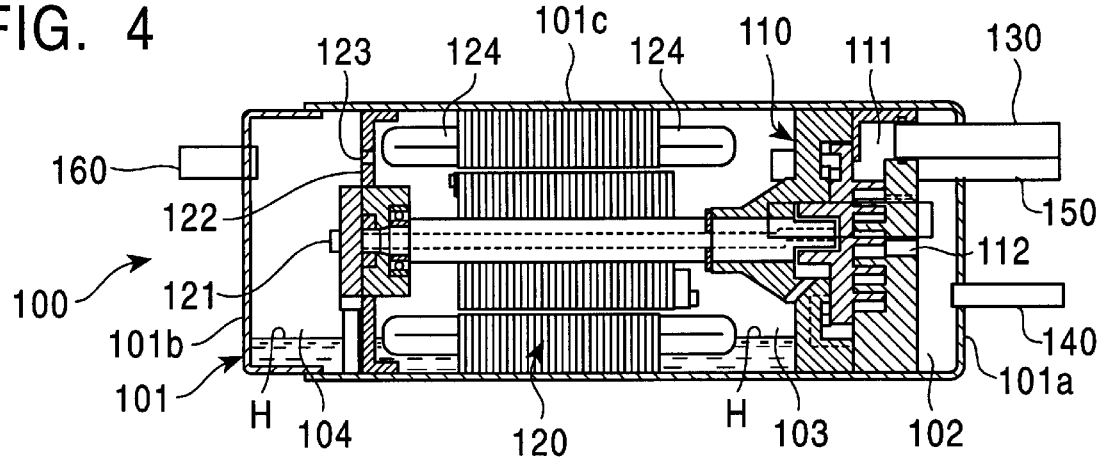
FIG. 4 is an enlarged sectional view showing a third modification of a compressor of the first invention.

Also, as shown in FIG. 4 as a third modification, the low-pressure refrigerant suction pipe 130, the first refrigerant flow path pipe 150, and the high-pressure refrigerant discharge pipe 140 are installed on the side of one end face 101*a* of the enclosed vessel 101, and the second refrigerant flow path pipe 160 is installed on the side of the other end face 101*b* of the enclosed vessel 101.

According to this configuration, a pipe need not be laid at the shell periphery 101*c* of the enclosed vessel 101. Therefore, when a heat insulating material is installed around the compressor 100, the work is made easy. Also, the enclosed vessel 101 can be assembled accurately without distortion.

In this third modification, the low-pressure refrigerant suction pipe 130 passes through the refrigerant discharge chamber 102 and is connected to the suction port 111 of the refrigerant compressing section 110, and the first refrigerant flow path pipe 150 passes through the refrigerant discharge chamber 102 and the refrigerant compressing section 110 and is drawn into the electric motor chamber 103.

Figure 5:
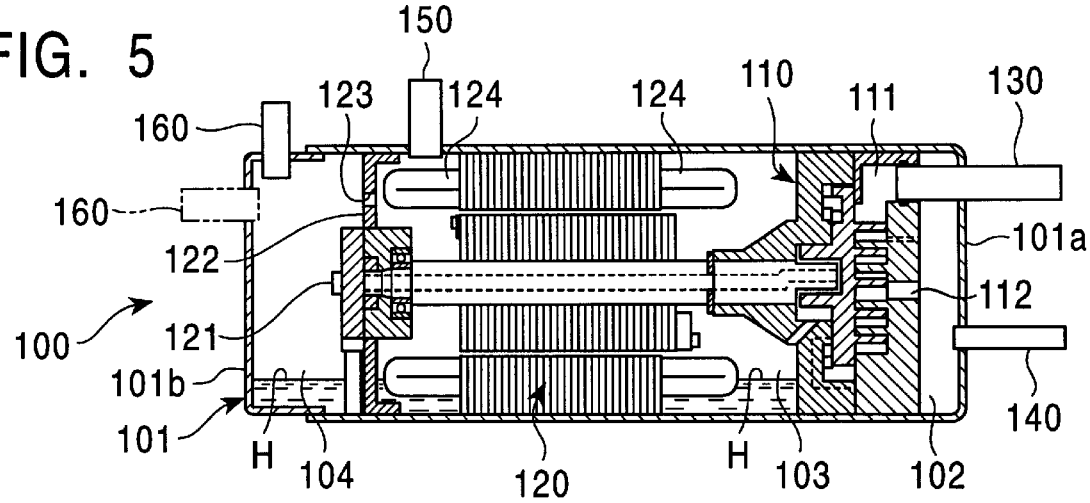
FIG. 5 is an enlarged sectional view showing a fourth modification of a compressor of the first invention.

As shown in FIG. 5 as a fourth modification, the first refrigerant flow path pipe 150 is laid on the coil 124 close to the subsidiary electric motor chamber 104 of the electric motor 120, and the second refrigerant flow path pipe 160 is installed at the upper part of the subsidiary electric motor chamber 104 or on the end face 101*b* on the side of the subsidiary electric motor chamber 104 as indicated by the chain line in the figure. According to this configuration, the heating of the refrigerant gas due to the electric motor 120 is less, so that the compression performance at the time of heating operation is increased. Also, the pressure difference between the electric motor chamber 103 on the side of the refrigerant compressing section 110 and the subsidiary electric motor chamber 104 decreases, so that the decrease in the oil surface level H in the subsidiary electric motor chamber 104 can be minimized.

Figure 6A:
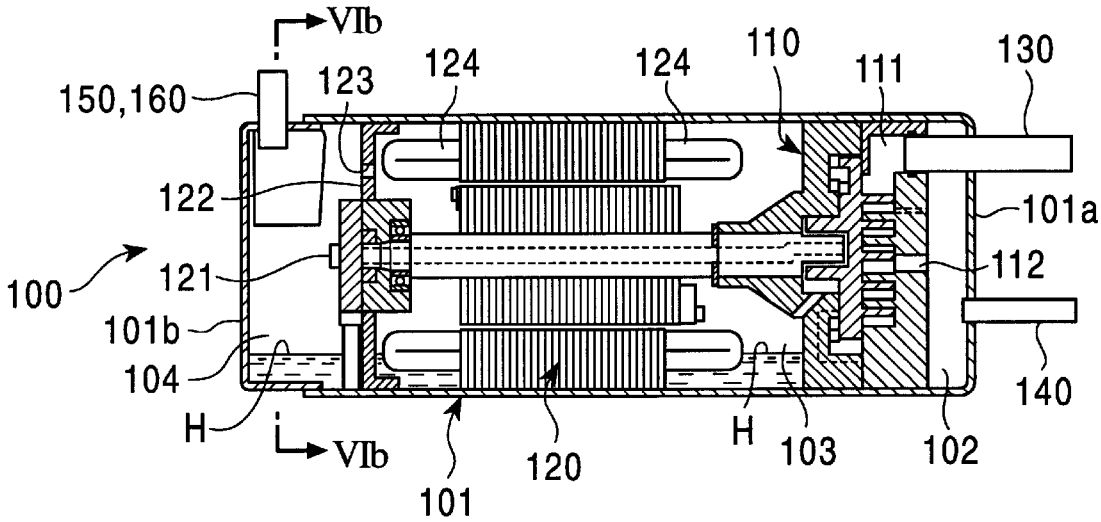
FIG. 6*a* is an enlarged sectional view showing a fifth modification of a compressor of the first invention.
Figure 6B:
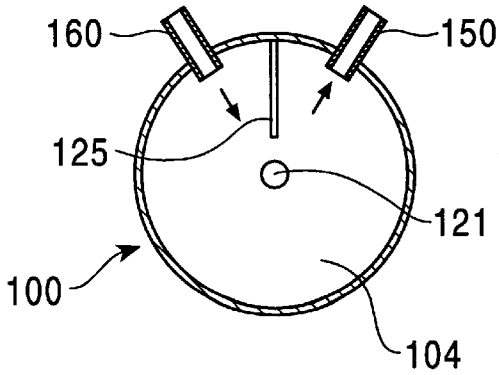
FIG. 6*b* is a sectional view taken along the line VIb—VIb of FIG. 6*a;*

Also, as shown in FIGS. 6*a* and 6*b* as a fifth modification, both of the first refrigerant flow path pipe 150 and the second refrigerant flow path pipe 160 are installed at the upper part of the subsidiary electric motor chamber 104. In this case, both of the refrigerant flow path pipes 150 and 160 are preferably installed symmetrically with respect to the axis of the enclosed vessel 101, that is, with respect to an imaginary vertical plane comprising the axis of the driving shaft 121, and at an angle such as to point at the axis, and also a oil separating plate 125 is provided therebetween. According to this configuration, the lubricating oil can be separated from the refrigerant gas efficiently. Also, like the above-described fourth modification, the heating of the refrigerant gas due to the electric motor 120 is less, so that the compression performance at the time of heating operation is increased.

Figure 7:
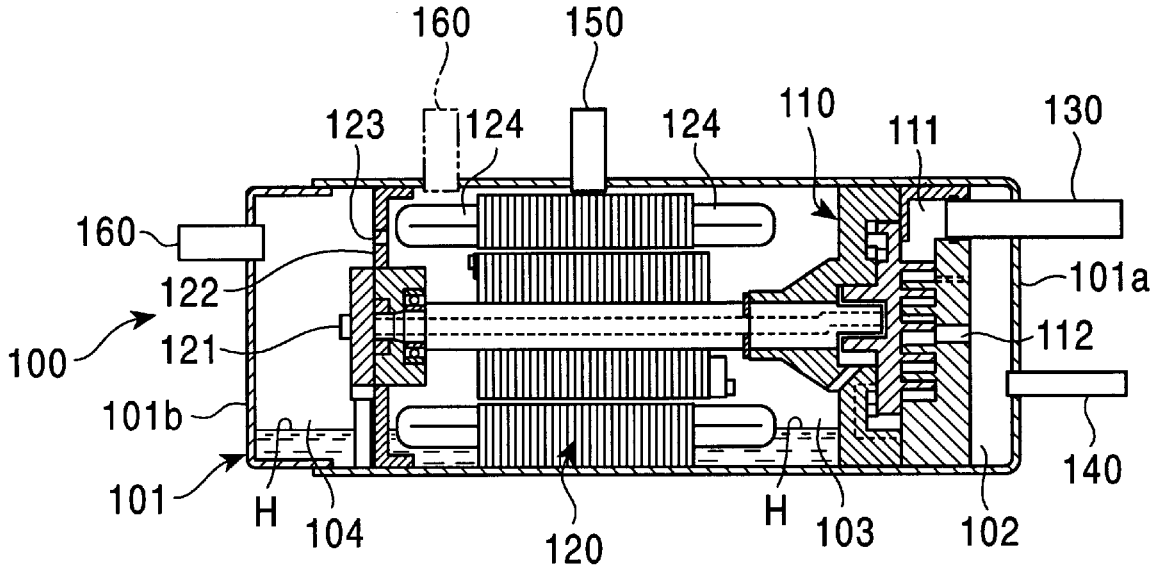
FIG. 7 is an enlarged sectional view showing a sixth modification of a compressor of the first invention.

As shown in FIG. 7 as a sixth modification, the first refrigerant flow path pipe 150 is provided at a position opposing to the upper center of the electric motor 120, and the second refrigerant flow path pipe 160 is provided on the side of the subsidiary electric motor chamber 104. Thereby, the oil surface levels H on both sides of the electric motor 120 can be kept approximately equal. Also, as in case of the fourth modification, the heating of the refrigerant gas due to the electric motor 120 is less, so that the compression performance at the time of heating operation is increased. In the sixth modification, as indicated by a chain line in FIG. 7, the second refrigerant flow path pipe 160 may be provided at a position opposing to the coil 124 on the side of the subsidiary electric motor chamber 104 of the electric motor 120.

Figure 8:
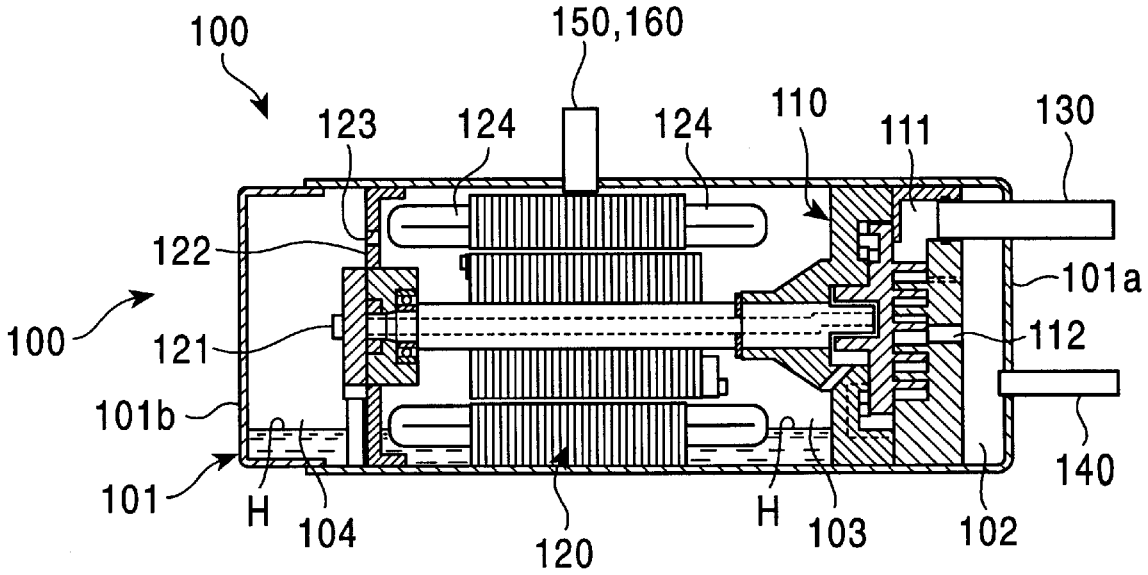
FIG. 8 is an enlarged sectional view showing a seventh modification of a compressor of the first invention.

Also, as shown in FIG. 8 as a seventh modification, both of the first refrigerant flow path pipe 150 and the second refrigerant flow path pipe 160 are arranged at positions opposing to the upper center of the electric motor 120 so as to be shifted at a predetermined interval along the peripheral direction of the enclosed vessel 101, and the refrigerant gas is blown to the electric motor 120 from either one of the refrigerant flow path pipes. Thereby, the lubricating oil can be separated from the refrigerant gas efficiently. Also, the oil surface levels H on both sides of the electric motor 120 can be kept approximately equal.

Figure 9:
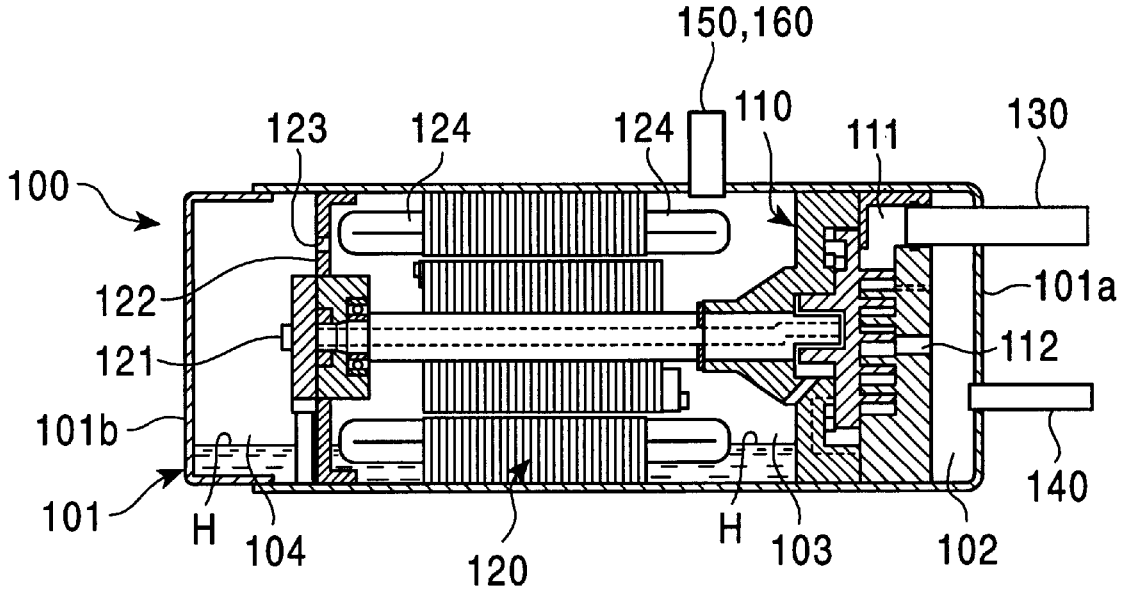
FIG. 9 is an enlarged sectional view showing an eighth modification of a compressor of the first invention.

Unlike the above-described seventh modification, as shown in FIG. 9 as an eighth modification, both of the first refrigerant flow path pipe 150 and the second refrigerant flow path pipe 160 may be arranged at positions between the electric motor 120 and the refrigerant compressing section 10 so as to be shifted at a predetermined interval along the peripheral direction of the enclosed vessel 101. In this configuration as well, the oil surface levels H on both sides of the electric motor 120 can be kept approximately equal. Also, the heating of the refrigerant gas due to the electric motor 120 is less, so that the compression performance at the time of heating operation is increased.

Figure 10:
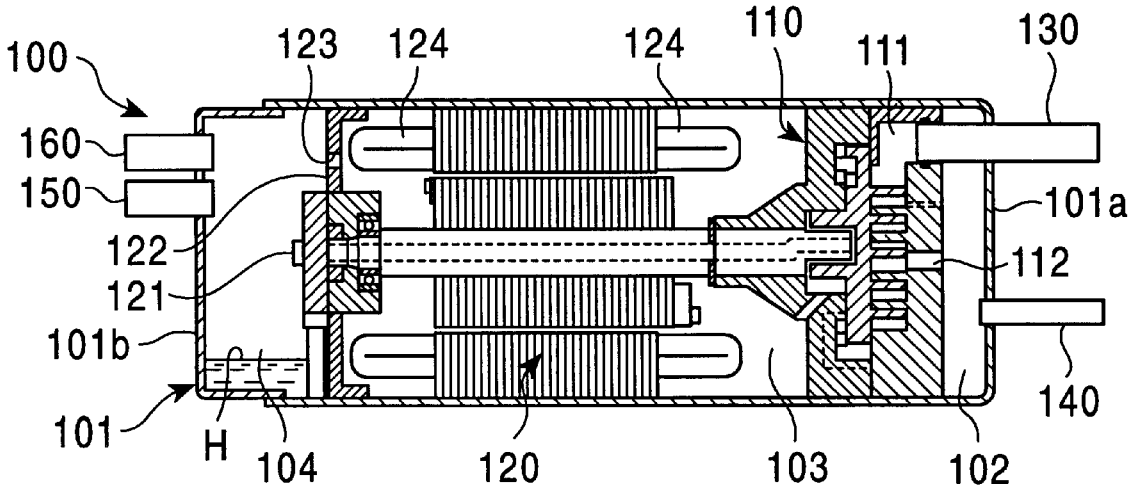
FIG. 10 is an enlarged sectional view showing a ninth modification of a compressor of the first invention.

In the above-described second to eighth modifications, the low-pressure refrigerant suction pipe 130 and the high-pressure refrigerant discharge pipe 140 are installed on the end face 101*a* on the side of the refrigerant discharge chamber 102 of the enclosed vessel 101. However, as shown in FIG. 10 as a ninth modification, both of the first refrigerant flow path pipe 150 and the second refrigerant flow path pipe 160 may also be arranged on the end face 101*b* on the side of the subsidiary electric motor chamber 104. According to this configuration, like the above-described third modification, a pipe need not be laid at the shell periphery 101*c* of the enclosed vessel 101. Therefore, when a heat insulating material is installed around the compressor 100, the work is made easy.

Also, not only the enclosed vessel 101 can be assembled accurately without distortion, but also the oil surface levels H on both sides of the electric motor 120 can be kept approximately equal. Also, the heating of the refrigerant gas due to the electric motor 120 is less, so that the compression performance at the time of heating operation can be increased.

Figure 11:
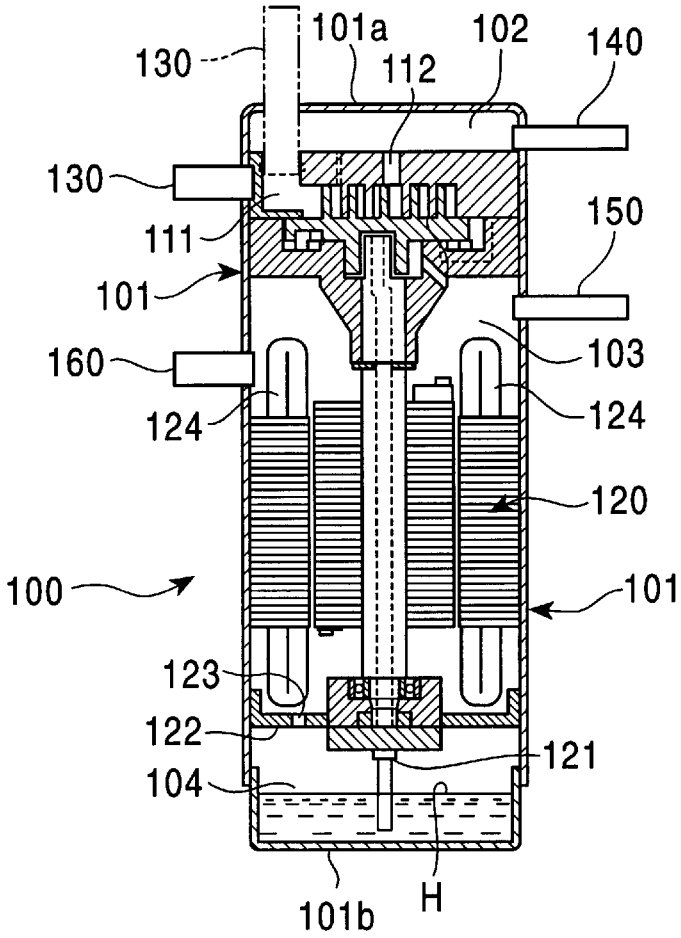
FIG. 11 is an enlarged sectional view showing a tenth modification of a compressor of the first invention.

FIG. 11 shows a tenth modification. This figure shows a case where the compressor 100 is used as a so-called vertical type. In this modification, when the enclosed vessel 101 is placed on the base frame, not shown, with the axis thereof being substantially vertical, the refrigerant compressing section 110 and the electric motor 120 serving as driving means therefor are contained in the enclosed vessel 101 in such a manner that the former is positioned above and the latter is below. Therefore, in the enclosed vessel 101, the refrigerant discharge chamber 102, the electric motor chamber 103, and the subsidiary electric motor chamber 104 are arranged in that order from the upside.

In case of the vertical type, it is preferable that the high-pressure refrigerant discharge pipe 140 connected to the refrigerant discharge chamber 102 and the first refrigerant flow path pipe 150 connected to the electric motor chamber 103 be arranged at the side on, for example, the right of the enclosed vessel 101 in FIG. 11, and the low-pressure refrigerant suction pipe 130 connected to the suction port 111 and the second refrigerant flow path pipe 160 connected to the electric motor chamber 103 be arranged at the side on, for example, the left of the enclosed vessel 101. According to this configuration, a pipe need not be laid on the side of the end faces 101*a* and 101*b* of the enclosed vessel 101. Accordingly, of the installation space of the compressor 100, the space in the height direction can be decreased.

Also, since the first and second refrigerant flow path pipes 150 and 160 are arranged at a part of the upper coil 124 of the electric motor 120, the separation efficiency of the refrigerant gas and lubricating oil can be increased. Also, the heating of the refrigerant gas due to the electric motor 120 is less, so that the compression performance at the time of heating operation can be increased.

Figure 12:
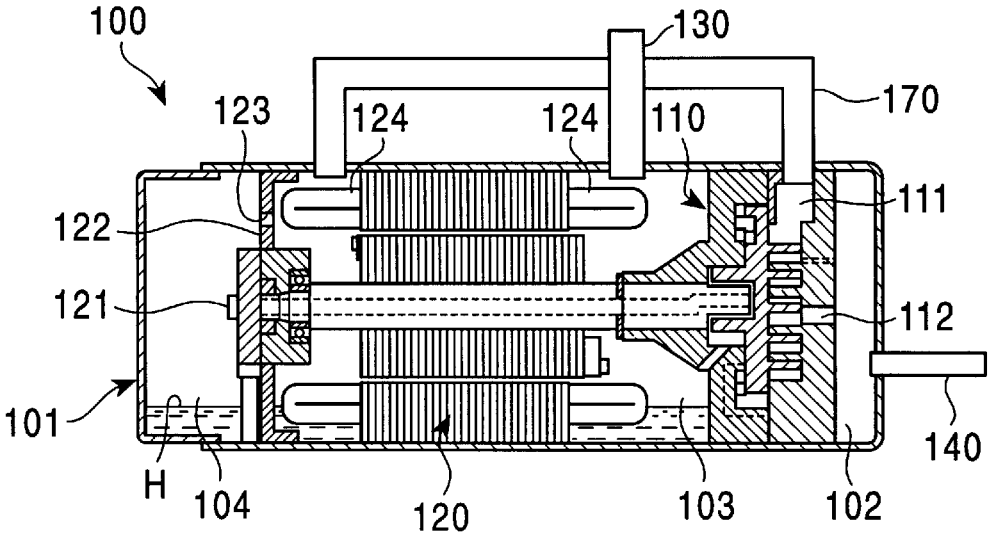
FIG. 12 is an enlarged sectional view showing an eleventh modification of a compressor of the first invention.

FIG. 12 shows an eleventh modification. This figure shows a case where the compressor 100 is of a so-called horizontal type, and is exclusively used as an internal low pressure type. In this modification, the low-pressure refrigerant suction pipe 130 is disposed so as to be opposed to the coil 124 on the side of the refrigerant compressing section 110 of the electric motor 120 in the electric motor chamber 103, and a bypass pipe 170 is drawn from a portion corresponding to the coil 124 on the side of the subsidiary electric motor chamber 104 of the electric motor 120, and is connected to the suction port 111 of the refrigerant compressing section 110.

In this case, the low-pressure refrigerant suction pipe 130 is connected to the first switching port 8*a* of the four-way switching valve 8, and the high-pressure refrigerant discharge pipe 140 of the refrigerant discharge chamber 102 is connected to the second switching port 8*b* of the four-way switching valve 8. Also, the third switching port 8*c* of the four-way switching valve 8 is connected with, for example, the outdoor-side heat exchanger 9, and the remaining fourth switching port 8*d* is connected with, for example, the indoor-side heat exchanger 11.

According to this eleventh modification, at the time of either of cooling operation and heating operation, the low-pressure refrigerant gas from the low-pressure refrigerant suction pipe 130 always passes through the electric motor chamber 103 and is returned to the refrigerant compressing section 110. For the internal low pressure type of this construction, the oil surface level H in the subsidiary electric motor chamber 104 can be kept high.

Figure 13:
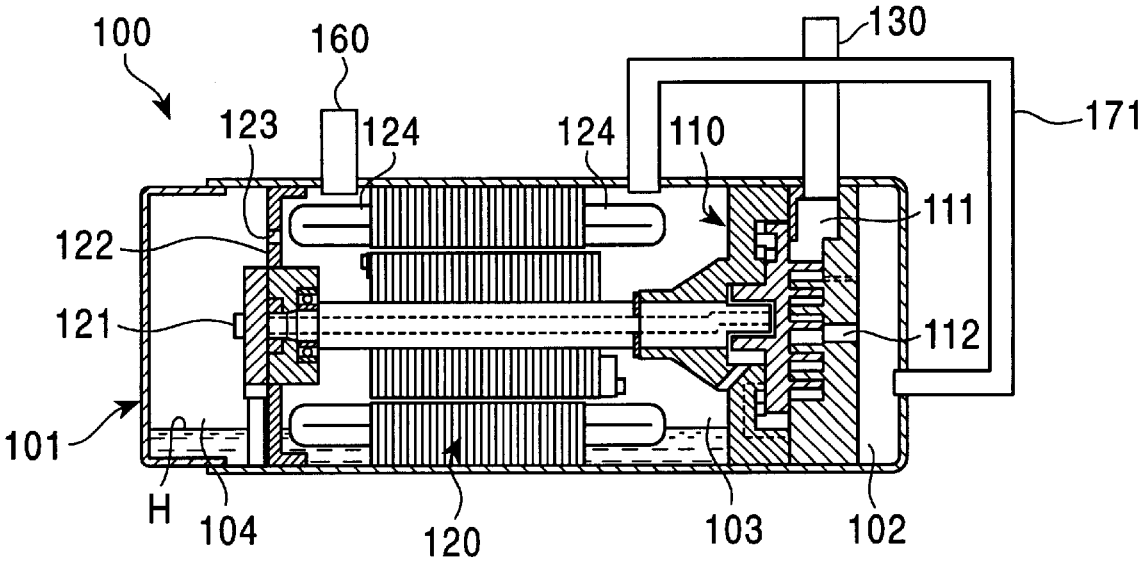
FIG. 13 is an enlarged sectional view showing a twelfth modification of a compressor of the first invention.

FIG. 13 shows a twelfth modification. This figure shows the case where the compressor 100 is of a so-called horizontal type, and is exclusively used as an internal high pressure type. This modification is based on the second modification shown in FIG. 3. In this modification, the low-pressure refrigerant suction pipe 130 is directly connected to the suction port 111 of the refrigerant compressing section 110. Also, the second refrigerant flow path pipe 160 is drawn from a portion corresponding to the coil 124 on the side of the subsidiary electric motor chamber 104 of the electric motor 102. A bypass pipe 171 is drawn from a portion corresponding to the coil 124 on the side of the refrigerant compressing section 110 of the electric motor 102, and the bypass pipe 171 is connected to the refrigerant discharge chamber 102.

In this case, the low-pressure refrigerant suction pipe 130 is connected to the first switching port 8*a* of the four-way switching valve 8, and the second refrigerant flow path pipe 160 is connected to the second switching port 8*b* of the four-way switching valve 8. Also, the third switching port 8*c* of the four-way switching valve 8 is connected with, for example, the outdoor-side heat exchanger 9, and the remaining fourth switching port 8*d* is connected with, for example, the indoor-side heat exchanger 11.

In case of this twelfth modification, at the time of either of cooling operation and heating operation, the high-temperature high-pressure refrigerant gas from the refrigerant discharge chamber 102 always passes through the electric motor chamber 103 and is discharged through the second refrigerant flow path pipe 160. For the internal high pressure type of this construction as well, like the above-described eleventh modification, the oil surface level H in the subsidiary electric motor chamber 104 can be kept high.

Next, a second invention will be described with reference to an embodiment shown in FIGS. 14*a* to 14*c*. According to this second invention, cooling operation by means of the internal high pressure type (FIG. 14*a*), heating operation by means of the internal low pressure type (FIG. 14*b*), and further heating operation by means of the internal high pressure type (FIG. 14*c*) can be performed by using one compressor.

In this second invention, the compressor, which is denoted by reference numeral 200, has the same basic configuration as that of the compressor 100 used for the first invention. Therefore, reference numerals for the compressor 100 are applied to the configuring elements of the compressor 200 which are the same or regarded as the same. For the details, the above-described first invention should be referred to.

That is, like the above-described compressor 100, this compressor 200 also has a horizontal-type cylindrical enclosed vessel 101, and the enclosed vessel 101 contains the refrigerant compressing section 110 having the suction port 111 and the discharge port 112, and the electric motor 120 for driving the refrigerant compressing section 110.

The interior of the enclosed vessel 101 is divided airtightly into two chambers, the refrigerant discharge chamber 102 on the side of the discharge port of the refrigerant compressing section and the electric motor chamber 103 containing the electric motor 120, by the refrigerant compressing section 110 serving as partitioning means.

On the side opposite to the refrigerant discharge chamber 102 of the electric motor chamber 103, the subsidiary electric motor chamber 104 is formed by the bearer plate 122 which pivotally supports the driving shaft 121 of the electric motor 120. The bearer plate 122 is formed with an arbitrary number of refrigerant flowing holes, so that the electric motor chamber 103 and the subsidiary electric motor chamber 104 communicate with each other.

In this second invention, the low-pressure refrigerant suction pipe 130 which is drawn from the first switching port 8*a* on the low-pressure refrigerant discharge side of the four-way switching valve 8 branches into two pipes at an intermediate position. A first branch suction pipe 131, one of the branch pipes, is connected directly to the suction port 111 of the refrigerant compressing section 110. This first branch suction pipe 131 is provided with a first opening/closing valve 210. A second branch suction pipe 132, the other of the branch pipes, is connected to the electric motor chamber 103, and this second branch suction pipe 132 is provided with a second opening/closing valve 211.

Also, the high-pressure refrigerant discharge pipe 140 connected to the second switching port 8*b* on the high-pressure refrigerant introduction side of the four-way switching valve 8 also branches into two pipes at an intermediate position. A first branch discharge pipe 141, one of the branch pipes, is connected to the subsidiary electric motor chamber 104. This first branch discharge pipe 141 is provided with a third opening/closing valve 212. A second branch discharge pipe 142, the other of the branch pipes, is connected to the refrigerant discharge chamber 102. This second branch discharge pipe 142 is provided with a fourth opening/closing valve 213.

Further, a first bypass pipe 133 reaching the subsidiary electric motor chamber 104 branches off from the downstream side of the first opening/closing valve 210 of the first branch suction pipe 131. This first bypass pipe 133 is provided with a fifth opening/closing valve 214. Also, a second bypass pipe 143 is provided between the electric motor chamber 103 and the refrigerant discharge chamber 102. This second bypass pipe 143 is provided with a sixth opening/closing valve 215. The second bypass pipe 143 may be laid between the upstream side of the fourth opening/closing valve of the second branch discharge pipe 142 and the electric motor chamber 103.

In this embodiment, the third switching port 8*c* of the four-way switching valve 8 is connected with the outdoor-side heat exchanger 9, and the fourth switching port 8*d* of the four-way switching valve 8 is connected with the indoor-side heat exchanger 11.

Figure 14A:
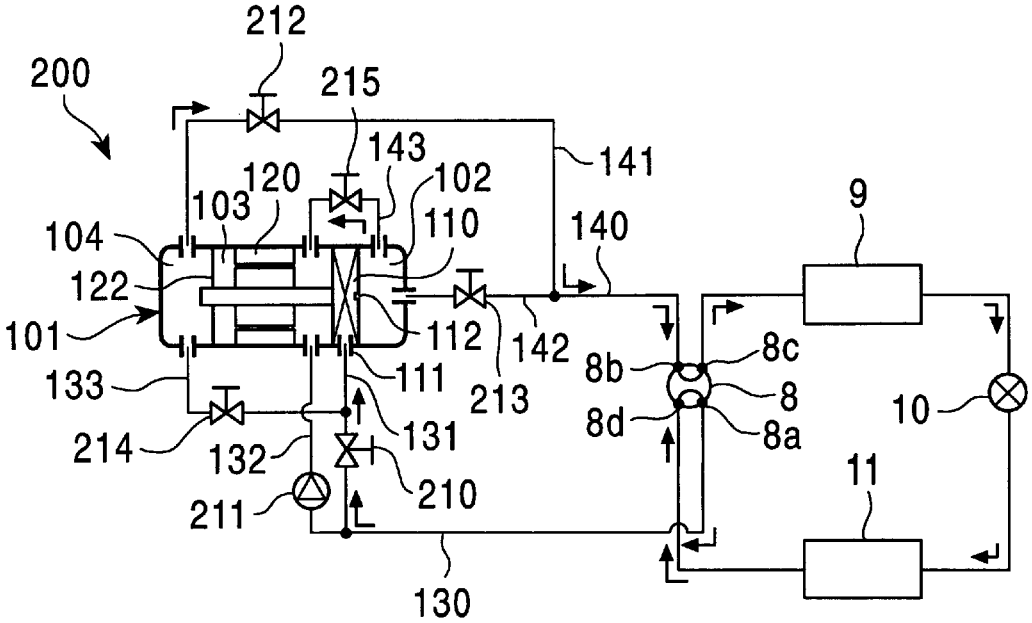
FIG. 14*a* is a schematic view showing a refrigerant circuit at the time of cooling operation using a compressor in accordance with an embodiment of a second invention as an internal high pressure type.

At the time of cooling operation, as shown in FIG. 14*a*, the second switching port 8*b* and the third switching port 8*c* are made in a communicating state, and the first switching port 8*a* and the fourth switching port 8*d* are made in a communicating state by the four-way switching valve 8. Also, the first opening/closing valve 210, the third opening/closing valve 212, and the sixth opening/closing valve 215 are opened, and the second opening/closing valve 211, the fourth opening/closing valve 213, and the fifth opening/closing valve 214 are closed.

Thereby, the low-pressure refrigerant gas is sucked into the refrigerant compressing section 110 through the low-pressure refrigerant suction pipe 130 and the first branch suction pipe 131, and the high-temperature high-pressure refrigerant gas produced in the refrigerant compressing section 110 is supplied to the side of the outdoor-side heat exchanger 9 through the refrigerant discharge chamber 102, the second bypass pipe 143, the electric motor chamber 103, the subsidiary electric motor chamber 104, the first branch discharge pipe 141, the high-pressure refrigerant discharge pipe 140, and the four-way switching valve 8.

Thus, at the time of cooling operation, the compressor 200 is used as the internal high pressure type, so that a high-performance steady operation is performed as compared with the internal low pressure type.

Figure 14B:
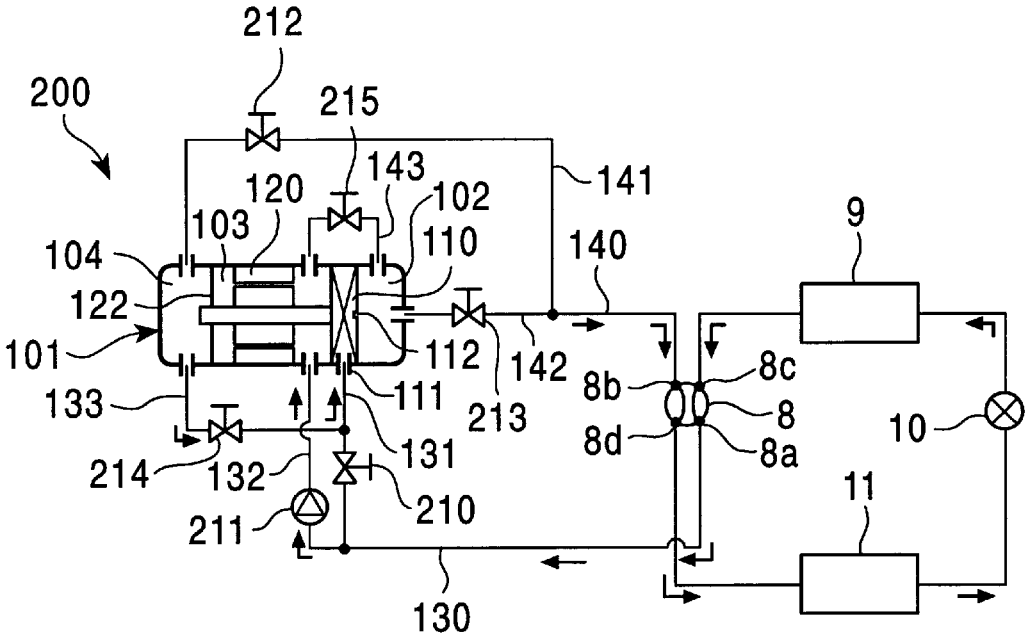
FIG. 14*b* is a schematic view showing a refrigerant circuit at the time of start when heating operation is performed using a compressor in accordance with an embodiment of the second invention as an internal low pressure type.
Figure 14C:
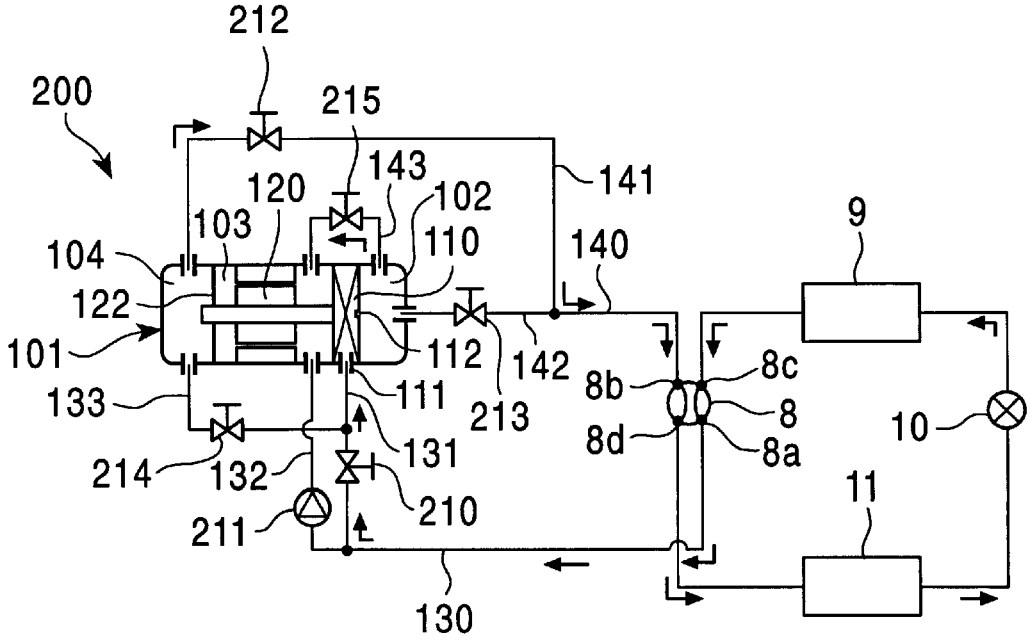
FIG. 14*c* is a schematic view showing a refrigerant circuit at the time of steady heating operation using a compressor in accordance with an embodiment of the second invention as an internal high pressure type.

On the other hand, at the time of heating operation, as shown in FIG. 14*b,* the second switching port 8*b* and the fourth switching port 8*d* are made in a communicating state, and the first switching port 8*a* and the third switching port 8*c* are made in a communicating state by the four-way switching valve 8. Also, the second opening/closing valve 211, the fourth opening/closing valve 213, and the fifth opening/closing valve 214 are opened, and the first opening/closing valve 210, the third opening/closing valve 212, and the sixth opening/closing valve 215 are closed.

Thereby, the low-pressure refrigerant gas enters the electric motor chamber 103 through the low pressure refrigerant suction pipe 130 and the second branch suction pipe 132, and is sucked into the suction port 111 of the refrigerant compressing section 110 from the subsidiary electric motor chamber 104 through the first bypass pipe 133. The high-temperature high-pressure refrigerant gas produced in the refrigerant compressing section 110 is supplied to the side of the indoor-side heat exchanger 11 through the refrigerant discharge chamber 102, the second branch discharge pipe 142, the high-pressure refrigerant discharge pipe 140, and the four-way switching valve 8.

Thus, at the time of heating operation, the compressor 200 is used as the internal low pressure type, so that warm air can be blown out from the indoor-side heat exchanger 11 in a short period of time from the start by preventing the high-temperature high-pressure refrigerant gas from passing through the electric motor chamber 103. For example, when heating operation is performed by means of a compressor of internal high pressure type, the required time from the start to the warm air blowout is about 3 minutes. Contrarily, according to this invention, the required time can be shortened to about 1 minute.

After a predetermined time has passed from the start of heating operation, in the state in which the second switching port 8*b* and the fourth switching port 8*d* communicate with each other and the first switching port 8*a* and the third switching port 8*c* communicate with each other, the first opening/closing valve 210, the third opening/closing valve 212, and the sixth opening/closing valve 215 are opened, and contrarily the second opening/closing vale 211, the fourth opening/closing valve 213, and the fifth opening/closing valve 214 are closed. Thereby, the compressor 200 is switched to the internal high pressure type. The flow of refrigerant at this time is shown in FIG. 14*c*. According to this embodiment, as in the case of cooling operation, a high-performance heating operation can be performed.

In the above-described embodiment, by using solenoid valves for the first opening/closing valve 210, the third opening/closing valve 212, the fourth opening/closing valve 213, the fifth opening/closing valve 214, and the sixth opening/closing valve 215, the switching control of the refrigerant circuit can be carried out exactly. The second opening/closing valve 211 may be a check valve. Also, the third opening/closing valve 212 may be a check valve.

Next, a modification of the second invention will be described with reference to FIG. 15. According to this modification, the compressor 200 has pipes and switching valves as described below.

The low-pressure refrigerant suction pipe 130 drawn from the first switching port 8*a* on the low-pressure refrigerant discharge side of the four-way switching valve 8 branches into two pipes at an intermediate position. A first branch suction pipe 135, one of the branch pipes, is connected directly to the suction port 111 of the refrigerant compressing section 110. This first branch suction pipe 135 is provided with a first opening/closing valve 220.

A second branch suction pipe 136, the other of the branch pipes, is connected to the electric motor chamber 103. In this case, at the pipe end of the second branch suction pipe 136, there is provided a first check valve 230 for checking a reverse flow from the side of the electric motor chamber 103.

Also, a first bypass pipe 137 is provided between the downstream side of the first opening/closing valve 220 of the first branch suction pipe 135 and the electric motor chamber 103. This first bypass pipe 137 is provided with a second opening/closing valve 221.

The second switching port 8*b* (for example, see FIG. 14*a*) on the high-pressure refrigerant introduction side of the four-way switching valve 8 and the subsidiary electric motor chamber 104 are connected to each other by the high-pressure refrigerant discharge pipe 140.

Also, the refrigerant discharge chamber 102 and the electric motor chamber 103 are connected to each other via a second bypass pipe 145. This second bypass pipe 145 is provided with a third opening/closing valve 222. Talking the refrigerant flow direction in the second bypass pipe 145 as the direction from the refrigerant discharge chamber 102 toward the electric motor chamber 103, a third bypass pipe 146 having a fourth opening/closing valve 223 is provided between the upstream side of the third opening/closing valve 222 of the second bypass pipe 145 and the subsidiary electric motor chamber 104.

In this modification, a partition 126 having a communicating hole 127 is provided between the electric motor chamber 103 and the subsidiary electric motor chamber 104 separately from the bearer plate 122. The communicating hole 127 in this partition 126 is provided with a second check valve 231 for checking a reverse flow from the side of the subsidiary electric motor chamber 104 to the side of the electric motor chamber 103. The second check valve 231 may be provided at the communicating hole in the bearer plate 122. In this case, the partition 126 need not be provided especially.

Figure 15:
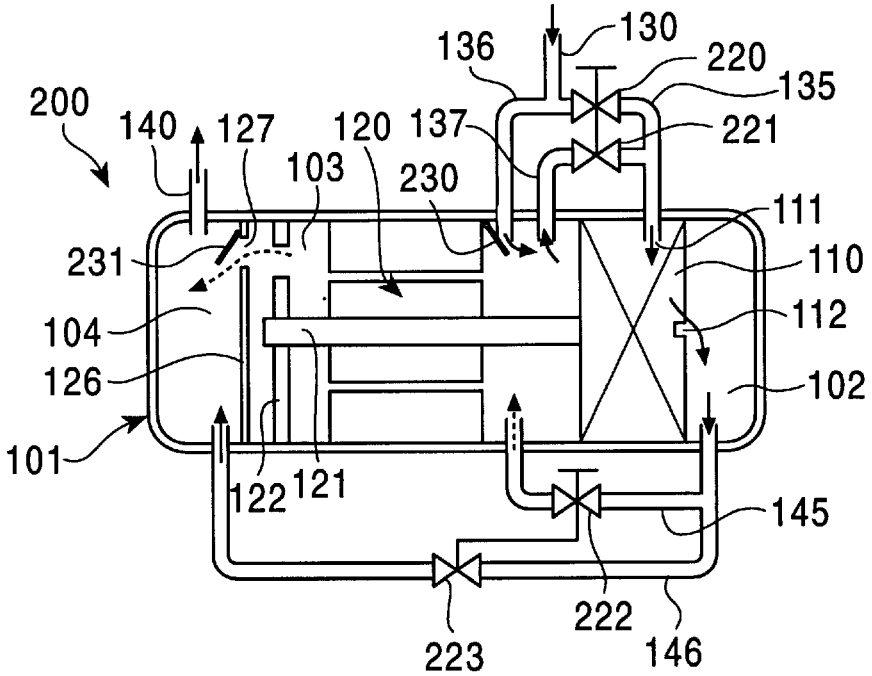
FIG. 15 is an enlarged sectional view showing another embodiment of a compressor applied to the second invention.

Although not shown in FIG. 15, like the above-described embodiment, the third switching port 8*c* of the four-way switching valve 8 is connected with the outdoor-side heat exchanger 9, and the fourth switching port 8*d* of the four-way switching valve 8 is connected with the indoor-side heat exchanger 11.

In this modification, at the time of cooling operation, the high-pressure refrigerant discharge pipe 140 of the second switching port 8*b* and the outdoor-side heat exchanger 9 of the third switching port 8*c* are caused to communicate with each other and the low-pressure refrigerant suction pipe 130 of the first switching port 8*a* and the indoor-side heat exchanger 11 of the fourth switching port 8*d* are caused to communicate with each other by the four-way switching valve 8. Also, the first opening/closing valve 220 and the third opening/closing valve 222 are opened, and the second opening/closing valve 221 and the fourth opening/closing valve 223 are closed. Thereby, the compressor 200 is operated as the internal high pressure type.

Specifically, the low-pressure refrigerant from the indoor-side heat exchanger 11 is sucked into the refrigerant compressing section 110 from the suction port 111 through the low-pressure refrigerant suction pipe 130 and the first branch suction pipe 135. The high-temperature high-pressure refrigerant gas produced in the refrigerant compressing section 110 is supplied to the electric motor chamber 103 through the second bypass pipe 145. Thereby, the first check valve 230 is closed. Thereafter, the high-temperature high-pressure refrigerant gas pushes to open the second check valve 231 and flows into the subsidiary electric motor chamber 104, and then is supplied to the outdoor-side heat exchanger 9 through the high-pressure refrigerant discharge pipe 140 and the four-way switching valve 8.

On the other hand, at the time of heating operation, the high-pressure refrigerant discharge pipe 140 of the second switching port 8*b* and the indoor-side heat exchanger 11 of the fourth switching port 8*d* are caused to communicate with each other and the low-pressure refrigerant suction pipe 130 of the first switching port 8*a* and the outdoor-side heat exchanger 9 of the third switching port 8*c* are caused to communicate with each other by the four-way switching valve 8. Also, the second opening/closing valve 221 and the fourth opening/closing valve 223 are opened, and the first opening/closing valve 220 and the third opening/closing valve 222 are closed. Thereby, the compressor 200 is operated as the internal low pressure type.

Specifically, in this case, the low-pressure refrigerant from the outdoor-side heat exchanger 9 flows into the electric motor chamber 103 through the low-pressure refrigerant suction pipe 130 and the second branch suction pipe 136, decreasing the pressure in the compressor, and then is sucked into the refrigerant compressing section 110 from the suction port 111 through the first bypass pipe 137. Then, the high-temperature high-pressure refrigerant gas produced in the refrigerant compressing section 110 is supplied from the refrigerant discharge chamber 102 to the subsidiary electric motor chamber 104 through the second bypass pipe 146. Thereby, the second check valve 231 is closed. Thereafter, the high-temperature high-pressure refrigerant gas is supplied to the indoor-side heat exchanger 11 through the high-pressure refrigerant discharge pipe 140 and the four-way switching valve 8.

After a predetermined time has passed from the start of heating operation, the four-way switching valve 8 being as it is, the first opening/closing valve 220 and the third opening/closing valve 222 are opened, and the second opening/closing valve 221 and the fourth opening/closing valve 223 are closed. Thereby, the compressor 200 is operated as the internal high pressure type.

In this modification, the first opening/closing valve 220 and the second opening/closing valve 221 should preferably be interlocking valves, in which when either one of the valves is opened, the other valve is closed, from the viewpoint of the valve switching control. Similarly, the third opening/closing valve 222 and the fourth opening/closing valve 223 should preferably be interlocking valves, in which when either one of the valves is opened, the other valve is closed.

Next, a third invention will be described with reference to an embodiment shown in FIGS. 16*a* to 16*c*. In this third invention as well, cooling operation by means of the internal high pressure type (FIG. 16*a*), heating operation by means of the internal low pressure type (FIG. 16*b*), and further heating operation by means of the internal high pressure type (FIG. 16*c*) can be performed by using one compressor.

In this third invention, the compressor, which is denoted by reference numeral 300, has the same basic configuration as that of the compressor 100 used for the first invention. Therefore, reference numerals for the compressor 100 are applied to the elements of the compressor 300 which are the same or regarded as the same. For the details, the above-described first invention should be referred to.

Specifically, like the above-described compressor 100, this compressor 300 also has a horizontal-type cylindrical enclosed vessel 101, and the enclosed vessel 101 contains the refrigerant compressing section 110 having the suction port 111 and the discharge port 112, and the electric motor 120 for driving the refrigerant compressing section 110.

The interior of the enclosed vessel 101 is divided airtightly into two chambers, the refrigerant discharge chamber 102 on the side of the discharge port of the refrigerant compressing section and the electric motor chamber 103 containing the electric motor 120, by the refrigerant compressing section 110 serving as partitioning means.

On the side opposite to the refrigerant discharge chamber 102 of the electric motor chamber 103, the subsidiary electric motor chamber 104 is formed by the bearer plate 122 which pivotally supports the driving shaft 121 of the electric motor 120. The bearer plate 122 is formed with an arbitrary number of refrigerant flowing holes, so that the electric motor chamber 103 and the subsidiary electric motor chamber 104 communicate with each other. Therefore, these two chambers may be regarded substantially as one chamber.

Figure 17:
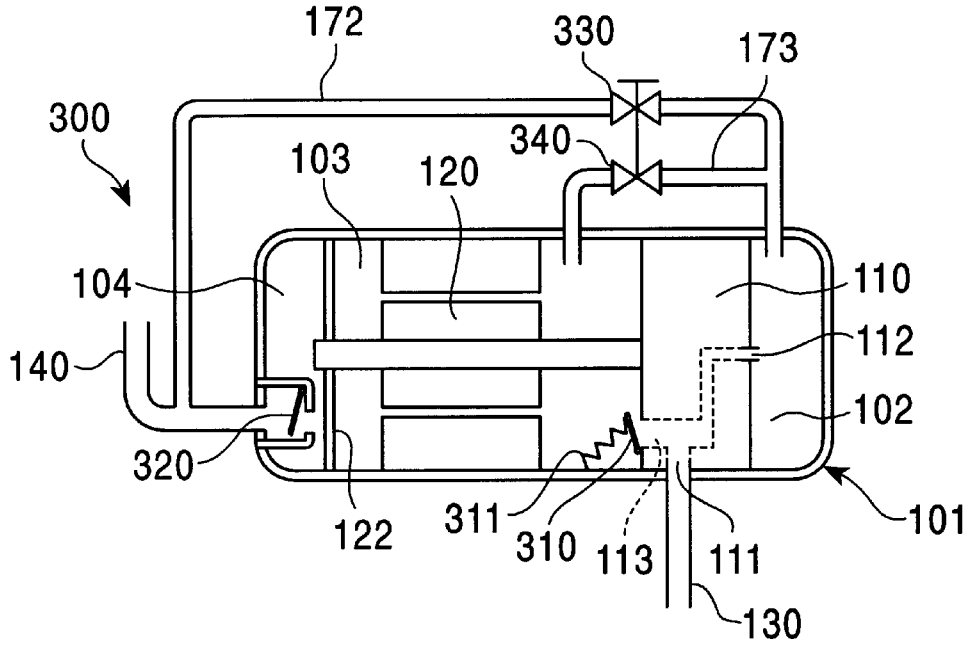
FIG. 17 is an enlarged sectional view of a compressor applied to the third invention.

According to the third invention, as shown enlargedly in FIG. 17, the refrigerant compressing section 110 has a refrigerant inflow port 113 reaching the suction port 111 from the side of the electric motor chamber 103, separately from the suction port 111.

The suction port 111 is connected with the low-pressure refrigerant suction pipe 130 drawn from the first switching port 8*a* on the low-pressure refrigerant discharge side of the four-way switching valve 8. The refrigerant inflow port 113 is provided with a first opening/closing valve 310. In this case, the first opening/closing valve 310 is urged by spring means 311 in the direction such that the inflow port is always opened. The spring urging force is regulated so that when the pressure in the electric motor chamber 103 reaches a predetermined value, the refrigerant inflow port 113 is closed.

The subsidiary electric motor chamber 104 and the second switching port 8*b* on the high-pressure refrigerant introduction side of the four-way switching valve 8 are connected to each other by the high-pressure refrigerant discharge pipe 140. This high-pressure refrigerant discharge pipe 140 is provided with a second opening/closing valve 320. In this embodiment, the second opening/closing valve 320, comprising a check valve for checking a reverse flow from the side of high-pressure refrigerant discharge pipe 140 to the side of the subsidiary electric motor chamber 104, is disposed at a connecting portion of the subsidiary electric motor chamber 104 and the high-pressure refrigerant discharge pipe 140.

The downstream side of the second opening/closing valve 320 of the high-pressure refrigerant discharge pipe 140 and the refrigerant discharge chamber 102 are connected to each other by a first bypass pipe 172. This first bypass pipe 172 is provided with a third opening/closing valve 330.

Also, taking the refrigerant flow direction in the first bypass pipe 172 as the direction from the refrigerant discharge chamber 102 toward the high-pressure refrigerant discharge pipe 140, a second bypass pipe 173 having a fourth opening/closing valve 340 is provided between the upstream side of the third opening/closing valve 330 of the first bypass pipe 172 and the electric motor chamber 103. The interlocking valves, in which when either one of the valves is opened, the other valve is closed, are used for the third opening/closing valve 330 and the fourth opening/closing valve 340.

In this embodiment as well, the third switching port 8*c* of the four-way switching valve 8 is connected with the outdoor-side heat exchanger 9, and the fourth switching port 8*d* of the four-way switching valve 8 is connected with the indoor-side heat exchanger 11.

Figure 16A:
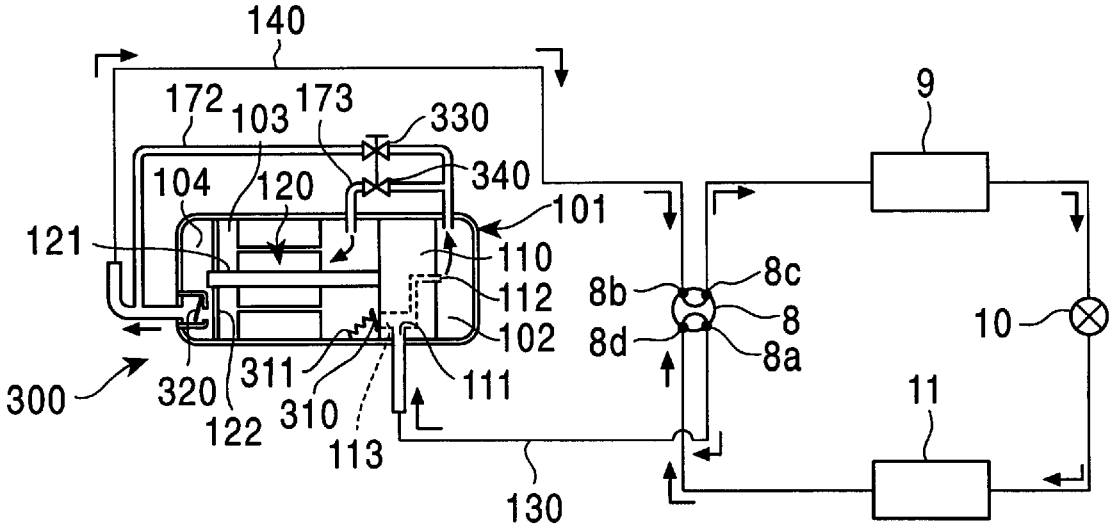
FIG. 16*a* is a schematic view showing a refrigerant circuit at the time of cooling operation using a compressor in accordance with an embodiment of a third invention as an internal high pressure type.

At the time of cooling operation, as shown in FIG. 16*a*, the high-pressure refrigerant discharge pipe 140 of the second switching port 8*b* and the outdoor-side heat exchanger 9 of the third switching port 8*c* are caused to communicate with each other and the low-pressure refrigerant suction pipe 130 of the first switching port 8*a* and the indoor-side heat exchanger 11 of the fourth switching port 8*d* are caused to communicate with each other by the four-way switching valve 8. Also, the fourth opening/closing valve 340 is opened, and the third opening/closing valve 330 is closed. Thereby, the compressor 300 is operated as the internal high pressure type.

That is, the low-pressure refrigerant gas from the side of the indoor-side heat exchanger 11 is sucked into the refrigerant compressing section 110 from the suction port 111 through the low-pressure refrigerant suction pipe 130, and the high-temperature high-pressure refrigerant gas produced in the refrigerant compressing section 110 is supplied from the refrigerant discharge chamber 102 to the electric motor chamber 103 through the second bypass pipe 173. Thereby, the pressure in the electric motor chamber 103 is made high, and the refrigerant inflow port 113 is closed by the first opening/closing valve 310. Thereafter, the high-temperature high-pressure refrigerant gas is supplied to the side of the outdoor-side heat exchanger 9 through the subsidiary electric motor chamber 104, the second opening/closing valve 320, the high-pressure refrigerant discharge pipe 140, and the four-way switching valve 8.

Figure 16B:
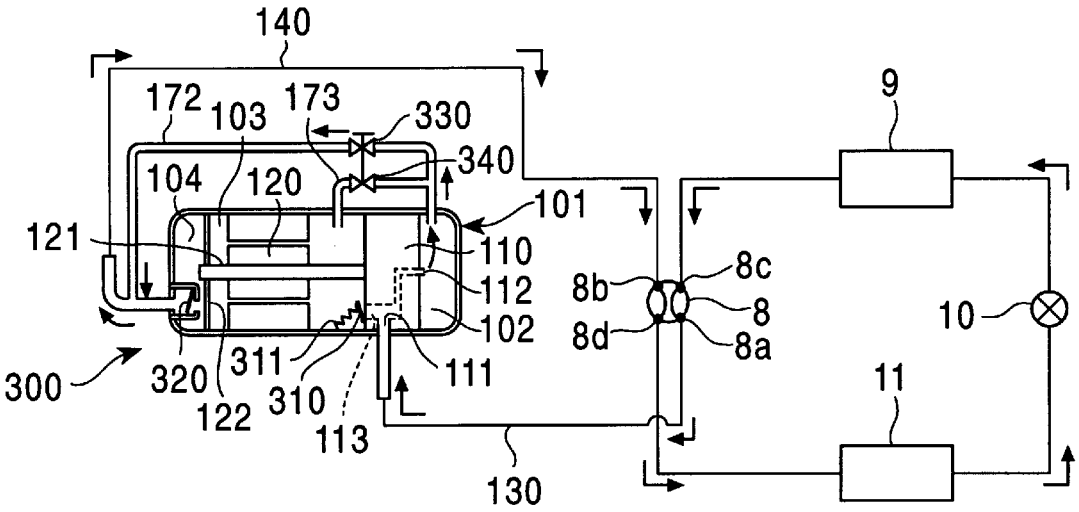
FIG. 16*b* is a schematic view showing a refrigerant circuit at the time of start when heating operation is performed using a compressor in accordance with an embodiment of the third invention as an internal low pressure type.
Figure 16C:
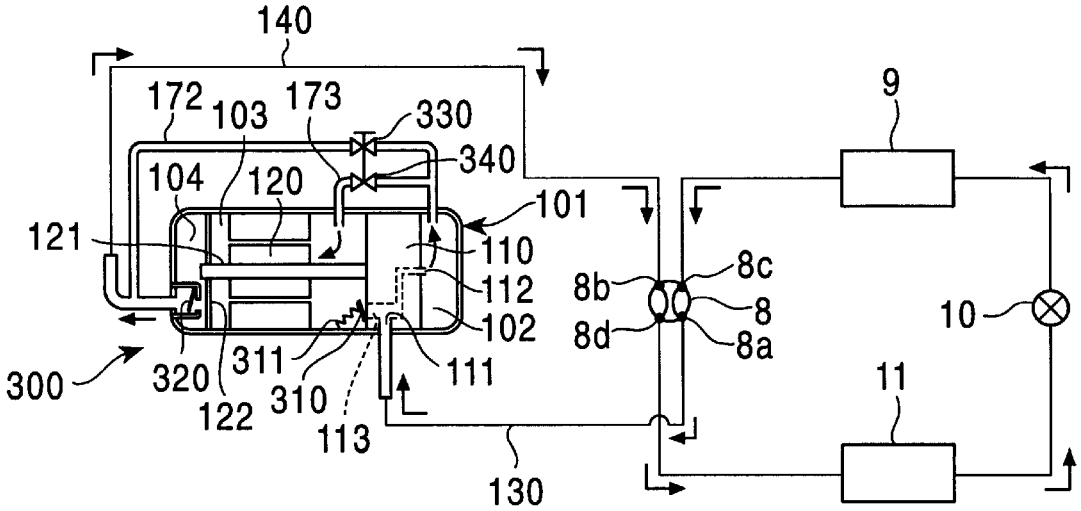
FIG. 16*c* is a schematic view showing a refrigerant circuit at the time of steady heating operation using a compressor in accordance with an embodiment of the third invention as an internal high pressure type.

At the time of heating operation, as shown in FIG. 16*b*, the high-pressure refrigerant discharge pipe 140 of the second switching port 8*b* and the indoor-side heat exchanger 11 of the fourth switching port 8*d* are caused to communicate with each other and the low-pressure refrigerant suction pipe 130 of the first switching port 8*a* and the outdoor-side heat exchanger 9 of the third switching port 8*c* are caused to communicate with each other by the four-way switching valve 8. Also, the third opening/closing valve 330 is opened, and the second opening/closing valve 320 is closed. Thereby, the compressor 300 is operated as the internal low pressure type.

That is, at the time of heating operation, the low-pressure refrigerant gas from the side of the outdoor-side heat exchanger 9 is sucked into the refrigerant compressing section 110 from the suction port 111 through the low-pressure refrigerant suction pipe 130. The high-temperature high-pressure refrigerant gas produced in the refrigerant compressing section 110 reaches the high-pressure refrigerant discharge pipe 140 from the first bypass pipe 172 without flowing in the electric motor chamber 103 from the refrigerant discharge chamber 102, and is supplied to the indoor-side heat exchanger 11 through the four-way switching valve 8. Thus, since the high-temperature high-pressure refrigerant gas is not supplied to the electric motor chamber 103, the first opening/closing valve 310 is opened, and therefore the pressure in the electric motor chamber 103 is kept low.

After a predetermined time has passed from the start of heating operation, the four-way switching valve 8 being as it is, the fourth opening/closing valve 340 is opened, and the third opening/closing valve 330 is closed. Thereby, heating operation is continued with the compressor 300 being operated as the internal high pressure type.

Next, a fourth invention will be described with reference to an embodiment shown in FIGS. 18*a* to 18*c*. In this fourth invention as well, cooling operation by means of the internal high pressure type FIG. 18*a*), heating operation by means of the internal low pressure type (FIG. 18*b*), and further heating operation by means of the internal high pressure type (FIG. 18*c*) can be performed by using one compressor.

In this fourth invention, the compressor, which is denoted by reference numeral 400, has the same basic configuration as that of the compressor 100 used for the first invention. Therefore, reference numerals for the compressor 100 are applied to the elements of the compressor 400 which are the same or regarded as the same, and the explanation of these elements is omitted.

In this fourth invention, taking the four-way switching valve 8 used in the first invention as a first four-way switching valve, a second four-way switching valve 81 is provided separately from the first four-way switching valve 8.

The suction port 111 of the refrigerant compressing section 110 is connected with the low-pressure refrigerant suction pipe 130 drawn from a first switching port 81*a* on the low-pressure refrigerant discharge side of the second four-way switching valve 81. Also, the refrigerant discharge chamber 102 is connected with the high-pressure refrigerant discharge pipe 140 reaching a second switching port 81*b* on the high-pressure refrigerant introduction side of the second four-way switching valve 81.

The electric motor chamber 103 is connected with one end of the first refrigerant flow path pipe 150, and the other end of the first refrigerant flow path pipe 150 is connected to a third switching port 81*c* of the second four-way switching valve 81. The subsidiary electric motor chamber 104 is connected with one end of the second refrigerant flow path pipe 160.

The other end side of the second refrigerant flow path pipe 160 branches into two pipes. One branch pipe 161 is connected to the first switching port 8*a* of the first four-way switching valve 8 via a first opening/closing valve 410. The other branch pipe 162 is connected to the second switching port 8*b* of the first four-way switching valve 8 via a second opening/closing valve 420.

Also, a fourth switching port 81*d* of the second four-way switching valve 81 is connected to the first four-way switching valve 8 via a pipe 180. This pipe 180 also branches into two pipes. One branch pipe 181 is connected to the second switching port 8*b* of the first four-way switching valve 8 via a third opening/closing valve 430, and the other branch pipe 182 is connected to the first switching port 8*a* of the first four-way switching valve 8 via a fourth opening/closing valve 440. The third switching port 8*c* of the first four-way switching valve 8 is connected with the outdoor-side heat exchanger 9, and the fourth switching port 8*d* thereof is connected with the indoor-side heat exchanger 11.

In this embodiment, the first refrigerant flow path pipe 150 is connected to the electric motor chamber 103, and the second refrigerant flow path pipe 160 is connected to the subsidiary electric motor chamber 104. The electric motor chamber 103 and the subsidiary electric motor chamber 104 are caused to communicate with each other by the refrigerant communicating hole 123 in the bearer plate 122, so that these two chambers may be regarded substantially as one chamber. Therefore, both of the first refrigerant flow path pipe 150 and the second refrigerant flow path pipe 160 may be connected to the electric motor chamber 103 or the subsidiary electric motor chamber 104.

Figure 18A:
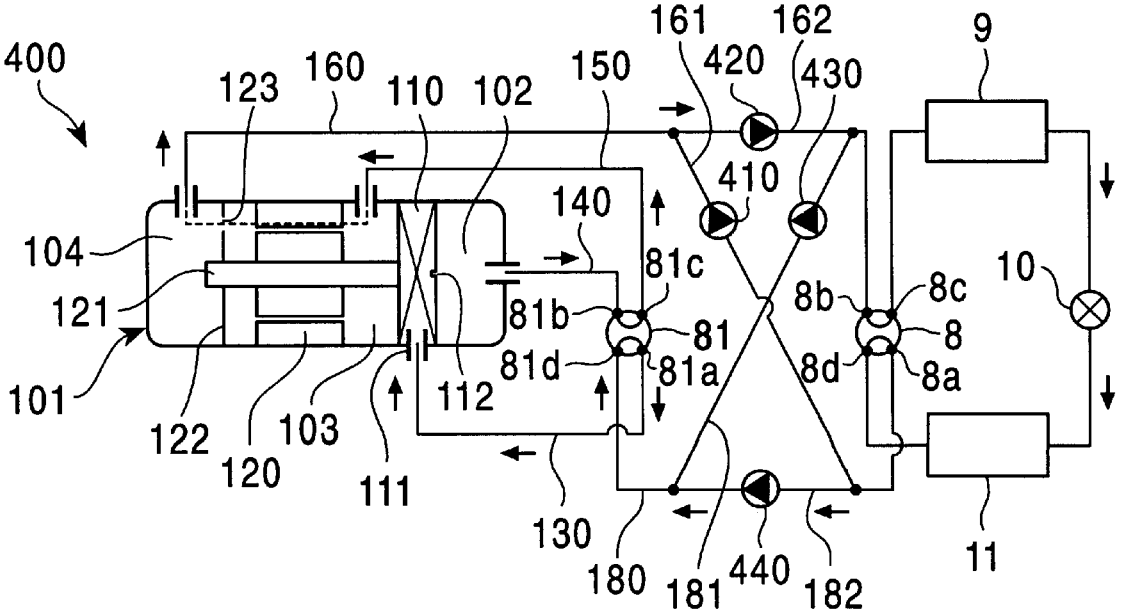
FIG. 18*a* is a schematic view showing a refrigerant circuit at the time of cooling operation using a compressor in accordance with an embodiment of a fourth invention as an internal high pressure type.

At the time of cooling operation, as shown in FIG. 18*a,* both of the first and second four-way switching valves 8 and 81 are switched so that the first switching port 8*a,* 81*a* thereof communicates with the fourth switching port 8*d,* 81*d,* and at the same time the second switching port 8*b,* 81*b* communicates with the third switching port 8*c,* 81*c*. Also, the second opening/closing valve 420 and the fourth opening/closing valve 440 are opened, and the first opening/closing valve 410 and the third opening/closing valve 430 are closed.

Thereby, the low-pressure refrigerant gas from the indoor-side heat exchanger 11 is sucked into the refrigerant compressing section 110 through the switching ports 8*d* and 8*a* of the first four-way switching valve 8, the fourth opening/closing valve 440, the switching ports 81*d* and 81*a* of the second four-way switching valve 81, and the low-pressure refrigerant suction pipe 130. The high-temperature high-pressure refrigerant gas produced in the refrigerant compressing section 110 is supplied to the electric motor chamber 103 through the high-pressure refrigerant discharge pipe 140, the switching ports 81*b* and 81*c* of the second four-way switching valve 81, and the first refrigerant flow path pipe 150, and is supplied from the subsidiary electric motor chamber 104 to the outdoor-side heat exchanger 9 through the second refrigerant flow path pipe 160, the second opening/closing valve 420, and the switching ports 8*b* and 8*c* of the first four-way switching valve 8. Thus, at the time of cooling operation, the compressor 400 is operated as the internal high pressure type.

Figure 18B:
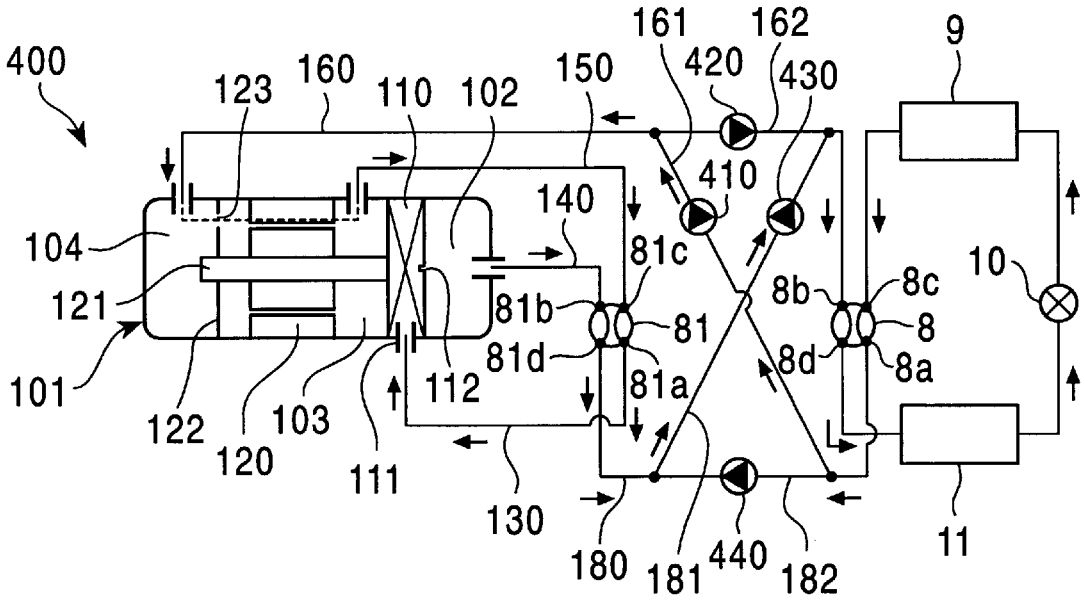
FIG. 18*b* is a schematic view showing a refrigerant circuit at the time of start when heating operation is performed using a compressor in accordance with an embodiment of the fourth invention as an internal low pressure type.

Contrarily, at the time of heating operation, as shown in FIG. 18*b,* both of the first and second four-way switching valves 8 and 81 are switched so that the second switching port 8*b,* 81*b* thereof communicates with the fourth switching port 8*d,* 81*d,* and at the same time the first switching port 8*a,* 81*a* communicates with the third switching port 8*c,* 81*c*. Also, the first opening/closing valve 410 and the third opening/closing valve 430 are opened, and the second opening/closing valve 420 and the fourth opening/closing valve 440 are closed.

Thereby, the low-pressure refrigerant gas from the outdoor-side heat exchanger 9 flows to the side of the subsidiary electric motor chamber 104 through the switching ports 8*c* and 8*a* of the first four-way switching valve 8, the first opening/closing valve 410, and the second refrigerant flow path pipe 160, and is sucked into the refrigerant compressing section 110 from the electric motor chamber 103 through the first refrigerant flow path pipe 150, the switching ports 81*c* and 81*a* of the second four-way switching valve 81, and the low-pressure refrigerant suction pipe 130. The high-temperature high-pressure refrigerant gas produced in the refrigerant compressing section 110 is supplied to the indoor-side heat exchanger 11 through the high-pressure refrigerant discharge pipe 140, the switching ports 81*b* and 81*d* of the second four-way switching valve 81, the third opening/closing valve 430, and the switching ports 8*b* and 8*d* of the first four-way switching valve 8. Thus, at the time of heating operation, the compressor 400 is operated as the internal low pressure type.

Figure 18C:
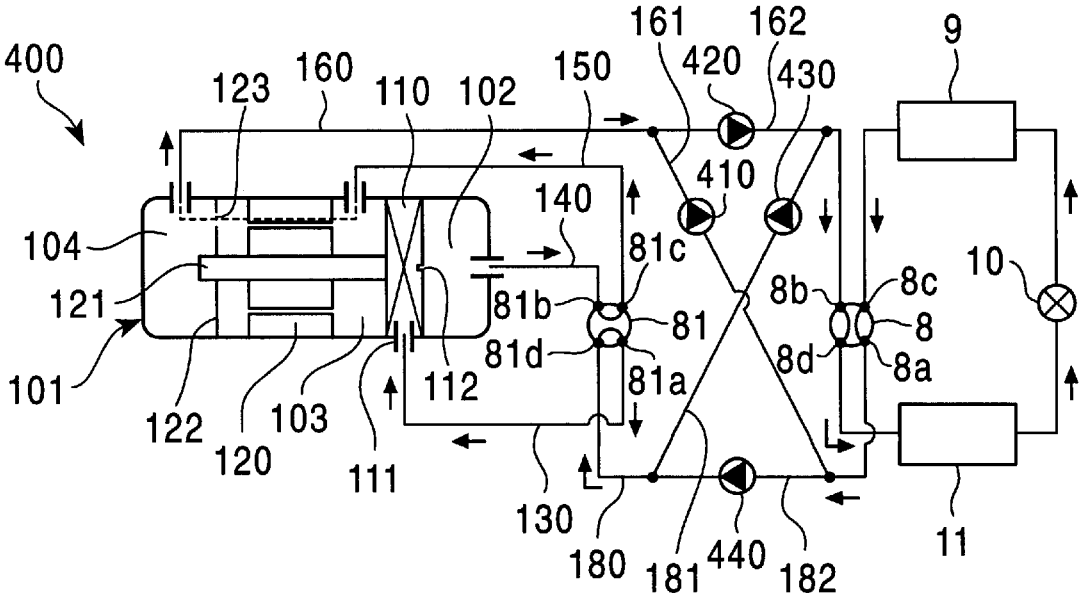
FIG. 18*c* is a schematic view showing a refrigerant circuit at the time of steady heating operation using a compressor in accordance with an embodiment of the fourth invention as an internal high pressure type.

After a predetermined time has passed from the start of heating operation, as shown in FIG. 18*c,* the first four-way switching valve 8 still being in the switching state at the time of heating operation, the second four-way switching valve 81 is switched to the state of cooling operation. Specifically, the switching ports 81*a* and 81*d* are caused to communicate with each other, and the switching ports 81*b* and 81*c* are caused to communicate with each other. Thereby, the compressor 400 can be operated as the internal high pressure type.

Each opening/closing valve may be a solenoid valve, but it should preferably be a check valve because the check valve does not require electrical valve control.

At this time, a check valve in which the direction from the side of the first four-way switching valve 8 toward the electric motor chamber 103 is the forward direction is used as the first opening/closing valve 410, a check valve in which the direction from the side of the electric motor chamber 103 toward the first four-way switching valve 8 is the forward direction is used as the second opening/closing valve 420, a check valve in which the direction from the side of the second four-way switching valve 81 toward the first four-way switching valve 8 is the forward direction is used as the third opening/closing valve 430, and a check valve in which the direction from the side of the first four-way switching valve 8 toward the second four-way switching valve 81 is the forward direction is used as the fourth opening/closing valve 440.

Figure 19A:
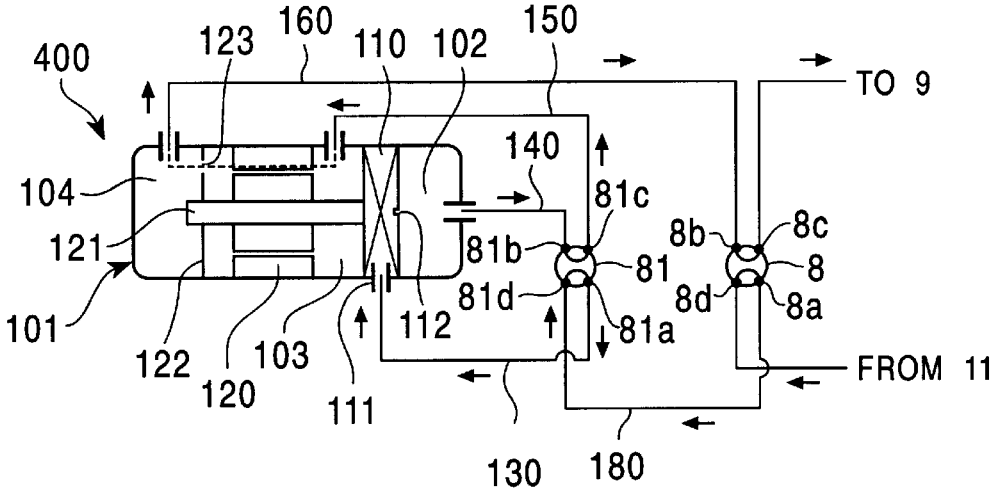
FIG. 19*a* is a schematic view showing a refrigerant circuit at the time of cooling operation using a compressor in accordance with a modification of the fourth invention as an internal high pressure type.
Figure 19B:
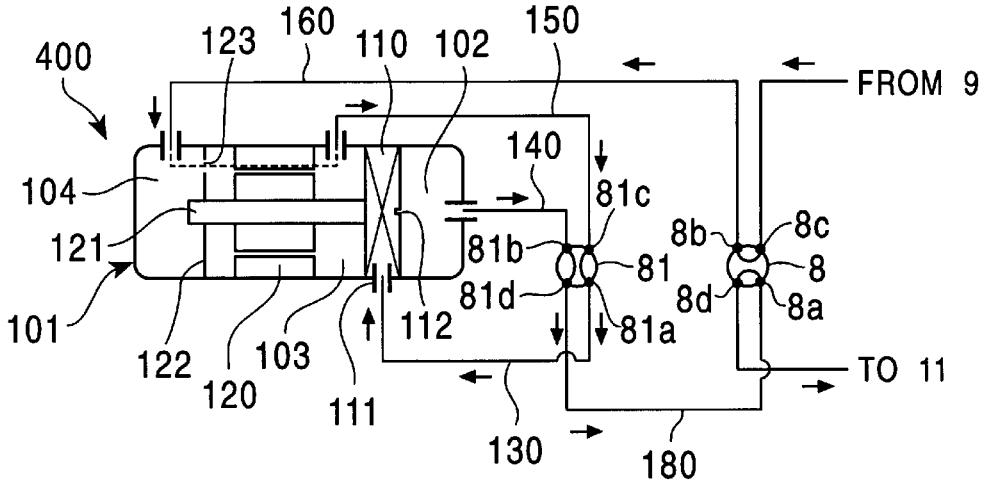
FIG. 19*b* is a schematic view showing a refrigerant circuit at the time of start when heating operation is performed using a compressor in accordance with a modification of the fourth invention as an internal low pressure type.
Figure 19C:
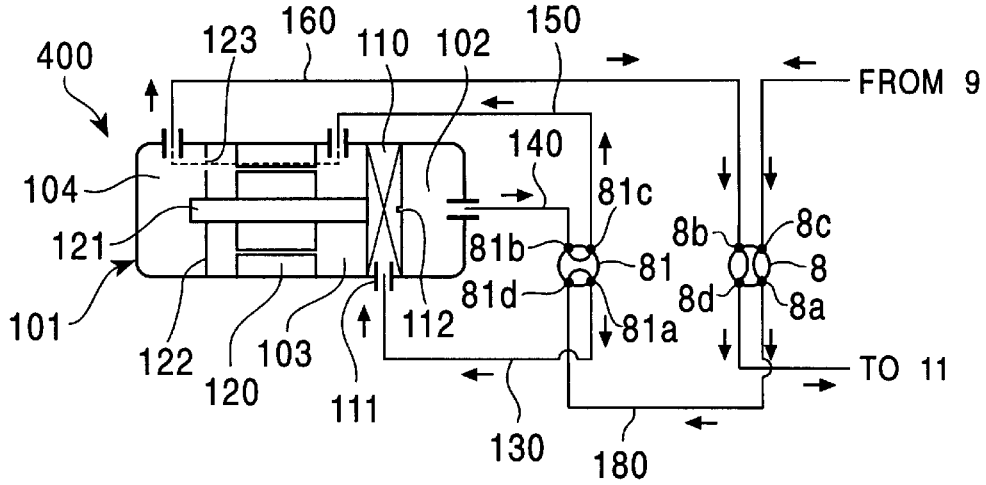
FIG. 19*c* is a schematic view showing a refrigerant circuit at the time of steady heating operation using a compressor in accordance with a modification of the fourth invention as an internal high pressure type.

The fourth invention can be modified as shown in FIGS. 19*a* to 19*c*. In this modification as well, cooling operation by means of the internal high pressure type (FIG. 19*a*), heating operation by means of the internal low pressure type (FIG. 19*b*), and further heating operation by means of the internal high pressure type (FIG. 19*c*) can be performed by using one compressor 400.

In this modification, unlike the above-described embodiment, the second refrigerant flow path pipe 160 and the pipe 180 do not branch, and the opening/closing valves are not used. The second refrigerant flow path pipe 160 is connected directly to the second switching port 8*b* of the first four-way switching valve 8, and the pipe 180 is also connected directly to the first switching port 8*a* of the first four-way switching valve 8.

At the time of cooling operation, as shown in FIG. 19*a,* the low-pressure refrigerant suction pipe 130 and the pipe 180 are caused to communicate with each other and the high-pressure refrigerant discharge pipe 140 and the first refrigerant flow path pipe 150 are caused to communicate with each other by the second four-way switching valve 81. Also, the second refrigerant flow path pipe 160 and the outdoor-side heat exchanger 9 are caused to communicate with each other and the pipe 180 and the indoor-side heat exchanger 11 are caused to communicate with each other by the first four-way switching valve 8. Thereby, the compressor 400 is operated as the internal high pressure type.

At the time of heating operation, as shown in FIG. 19*b,* only the second four-way switching valve 81 is switched so that the high-pressure refrigerant discharge pipe 140 and the pipe 180 communicate with each other and the first refrigerant flow path pipe 150 and the low-pressure refrigerant suction pipe 130 communicate with each other. The first four-way switching valve 8 remains in the state of cooling operation. Thereby, the compressor 400 is operated as the internal low pressure type.

After a predetermined time has passed from the start of heating operation, as shown in FIG. 19*c*, the second four-way switching valve 81 is switched so that the low-pressure refrigerant suction pipe 130 and the pipe 180 communicate with each other and the high-pressure refrigerant discharge pipe 140 and the first refrigerant flow path pipe 150 communicate with each other. Also, the first four-way switching valve 8 is switched so that the second refrigerant flow path pipe 160 and the indoor-side heat exchanger 11 communicate with each other and the outdoor-side heat exchanger 9 and the pipe 180 communicate with each other. Thereby, the heating operation can be continued with the compressor 400 being operated as the internal high pressure type.

The invention has been described above in detail with reference to some embodiments. Those skilled in the art who have understood the details of the present invention will easily think out the modifications, changes, and equivalence. Therefore, the scope of the present invention should be the accompanying claims and the equivalent scope thereof.

What is claimed is:

1. An air conditioner having a refrigerant circuit comprising:

a compressor;

a four-way switching valve;

an outdoor-side heat exchanger and an indoor-side heat exchanger which are selectively switched and connected to the high-pressure refrigerant discharge side and the low-pressure refrigerant suction side of said compressor via said four-way switching valve; and an expansion valve connected between said outdoor-side heat exchanger and said indoor-side heat exchanger, characterized in that said compressor has an enclosed vessel, said enclosed vessel contains a refrigerant compressing section having a suction port and a discharge port and an electric motor for driving said refrigerant compressing section, and the interior of said enclosed vessel is divided airtightly into two chambers, an electric motor chamber containing said electric motor and a refrigerant discharge chamber on the side of the discharge port of said refrigerant compressing section, by said refrigerant compressing section serving as partitioning means;

the suction port of said refrigerant compressing section is connected with a low-pressure refrigerant suction pipe and said refrigerant discharge chamber is connected with a high-pressure refrigerant discharge pipe, and said electric motor chamber is connected with a first refrigerant flow path pipe and a second refrigerant flow path pipe at different positions of said electric motor chamber;

of four switching ports of said four-way switching valve, a first switching port is connected with the low-pressure refrigerant suction pipe of said suction port, a second switching port is connected with the high-pressure refrigerant discharge pipe of said refrigerant discharge chamber, a third switching port is connected with the first refrigerant flow path pipe of said electric motor chamber, and a fourth switching port is connected with said indoor-side heat exchanger, and also the second refrigerant flow path pipe of said electric motor chamber is connected to the side of said outdoor-side heat exchanger;

at the time of cooling operation, said four-way switching valve is switched so that said first switching port and said fourth switching port communicate with each other and at the same time said second switching port and said third switching port communicate with each other, whereby said compressor is operated as an internal high pressure type; and at the time of heating operation, said four-way switching valve is switched so that said first switching port and said third switching port communicate with each other and at the same time said second switching port and said fourth switching port communicate with each other, whereby said compressor is operated as an internal low pressure type.

2. The air conditioner according to claim 1, characterized in that said four-way switching valve is installed integrally with said enclosed vessel.

3. The air conditioner according to claim 1, characterized in that a subsidiary electric motor chamber capable of communicating with said electric motor chamber is formed by a bearer plate pivotally supporting one end of a driving shaft of said electric motor on the side opposite to the refrigerant discharge chamber of said electric motor chamber, and said second refrigerant flow path pipe is connected to said subsidiary electric motor chamber.

4. The air conditioner according to claim 1, characterized in that said low-pressure refrigerant suction pipe is connected to the suction port of said refrigerant compressing section from the end face on the side of the refrigerant discharge chamber of said enclosed vessel via said refrigerant discharge chamber.

5. The air conditioner according to claim 1, characterized in that said first refrigerant flow path pipe is disposed at a position opposing to one end side of a coil of said electric motor, and said second refrigerant flow path pipe is disposed at a position opposing to the other end side of the coil of said electric motor.

6. The air conditioner according to claim 1, characterized in that both of said low-pressure refrigerant suction pipe and said first refrigerant flow path pipe are caused to pass through said refrigerant discharge chamber from the end face on the side of the refrigerant discharge chamber of said enclosed vessel, said low-pressure refrigerant suction pipe is connected to the suction port of said refrigerant compressing section, said first refrigerant flow path pipe further passes through said refrigerant compressing section and is drawn into said electric motor chamber, said high-pressure refrigerant discharge pipe is connected to the end face on the side of the refrigerant discharge chamber, and said second refrigerant flow path pipe is connected to the end face on the side of the electric motor chamber of said enclosed vessel.

7. The air conditioner according to claim 1, characterized in that said first refrigerant flow path pipe is disposed at a position opposing to one end of the coil of said electric motor, and said second refrigerant flow path pipe is disposed at an upper corner of said electric motor chamber.

8. The air conditioner according to claim 1, characterized in that said first refrigerant flow path pipe is disposed at a position opposing to one end of the coil of said electric motor, and said second refrigerant flow path pipe is disposed on an end face of said electric motor chamber.

9. The air conditioner according to claim 1, characterized in that said first refrigerant flow path pipe is disposed at a position opposing to a central portion of said electric motor, and said second refrigerant flow path pipe is disposed on the end face of said electric motor chamber.

10. The air conditioner according to claim 1, characterized in that both of said first refrigerant flow path pipe and said second refrigerant flow path pipe are disposed at positions opposing to the central portion of said electric motor so as to be installed symmetrically with respect to an imaginary vertical plane comprising the axis of said enclosed vessel and at an angle such as to point at said axis.

11. The air conditioner according to claim 1, characterized in that on the side opposite to the refrigerant discharge chamber of said electric motor chamber, said first refrigerant flow path pipe and said second refrigerant flow path pipe are installed symmetrically with respect to an imaginary vertical plane comprising the axis of said enclosed vessel and at an angle such as to point at said axis, and an oil separating plate for separating oil from a refrigerant gas is provided along said imaginary vertical plane in said electric motor chamber.

12. The air conditioner according to claim 1, characterized in that said first refrigerant flow path pipe and said second refrigerant flow path pipe are installed between said electric motor and said refrigerant compressing section so as to be symmetrical with respect to an imaginary vertical plane comprising the axis of said enclosed vessel and at an angle such as to point at said axis.

13. The air conditioner according to claim 1, characterized in that said low-pressure refrigerant suction pipe is caused to pass through said refrigerant discharge chamber from the end face on the side of the refrigerant discharge chamber of said enclosed vessel and is connected to the suction port of said refrigerant compressing section, said high-pressure refrigerant discharge pipe is connected to the end face on the side of the refrigerant discharge chamber, and said first refrigerant flow path pipe and said second refrigerant flow path pipe are connected to the end face on the side of the electric motor chamber of said enclosed vessel.

14. The air conditioner according to claim 1, characterized in that when said enclosed vessel is placed vertically with the axis thereof being substantially vertical, said refrigerant compressing section and said electric motor are contained in said enclosed vessel in such a manner that the former is positioned above and the latter is below, and the interior of said enclosed vessel is divided airtightly into two chambers, the refrigerant discharge chamber on the side of the discharge port of said refrigerant compressing section and the electric motor chamber containing said electric motor, by said refrigerant compressing section serving as partitioning means;

the suction port of said refrigerant compressing section is connected with the low-pressure refrigerant suction pipe from the side face of said enclosed vessel, and said refrigerant discharge chamber is connected with the high-pressure refrigerant discharge pipe from the side face of said enclosed vessel; and both of said first and second refrigerant flow path pipes are connected to said electric motor chamber from the side face of said enclosed vessel.

15. The air conditioner according to claim 1, characterized in that said compressor is a scroll-type compressor.

16. An air conditioner having a refrigerant circuit comprising:

a compressor;

a four-way switching valve;

an outdoor-side heat exchanger and an indoor-side heat exchanger which are selectively switched and connected to the high-pressure refrigerant discharge side and the low-pressure refrigerant suction side of said compressor via said four-way switching valve; and an expansion valve connected between said outdoor-side heat exchanger and said indoor-side heat exchanger, characterized in that said compressor has an enclosed vessel, said enclosed vessel contains a refrigerant compressing section having a suction port and a discharge port and an electric motor for driving said refrigerant compressing section, and the interior of said enclosed vessel is divided airtightly into two chambers, an electric motor chamber containing said electric motor and a refrigerant discharge chamber on the side of the discharge port of said refrigerant compressing section, by said refrigerant compressing section serving as partitioning means;

said refrigerant discharge chamber is connected with a high-pressure refrigerant discharge pipe, said electric motor chamber is connected with a low-pressure refrigerant suction pipe at a position between said electric motor and said refrigerant compressing section, and a low-pressure refrigerant flow path pipe for causing said electric motor chamber and the suction port of said refrigerant compressing section to communicate with each other at a position on the side opposite to the refrigerant discharge chamber of said electric motor chamber; and said high-pressure refrigerant discharge pipe and said low-pressure refrigerant suction pipe are connected to said refrigerant circuit via said four-way switching valve, whereby said compressor is operated as an internal low pressure type.

17. An air conditioner having a refrigerant circuit comprising:

a compressor;

a four-way switching valve;

an outdoor-side heat exchanger and an indoor-side heat exchanger which are selectively switched and connected to the high-pressure refrigerant discharge side and the low-pressure refrigerant suction side of said compressor via said four-way switching valve; and an expansion valve connected between said outdoor-side heat exchanger and said indoor-side heat exchanger, characterized in that said compressor has an enclosed vessel, said enclosed vessel contains a refrigerant compressing section having a suction port and a discharge port and an electric motor for driving said refrigerant compressing section, and the interior of said enclosed vessel is divided airtightly into two chambers, an electric motor chamber containing said electric motor and a refrigerant discharge chamber on the side of the discharge port of said refrigerant compressing section, by said refrigerant compressing section serving as partitioning means;

the suction port of said refrigerant compressing section is connected with a low-pressure refrigerant suction pipe, said refrigerant compressing section and said electric motor chamber are caused to communicate with each other by a high-pressure refrigerant flow path pipe, said electric motor chamber is connected with a high-pressure refrigerant discharge pipe, and said low-pressure refrigerant suction pipe and said high-pressure refrigerant discharge pipe are connected to said refrigerant circuit via said four-way switching valve, whereby said compressor is operated as an internal high pressure type.

18. The air conditioner according to claim 17, characterized in that one end side of said high-pressure refrigerant flow path pipe is connected to a position between said electric motor of said electric motor chamber and said refrigerant compressing section, and said high-pressure refrigerant discharge pipe is connected to a position on the side opposite to the refrigerant discharge chamber of said electric motor chamber.

* * * * *